US011447953B2

(12) United States Patent
Haynes et al.

(10) Patent No.: US 11,447,953 B2
(45) Date of Patent: Sep. 20, 2022

(54) ROOF, SIDING, OR CLADDING, OR RIDGE OR HIP MEMBER FOR A ROOF

(71) Applicant: Zinniatek Limited, Auckland (NZ)

(72) Inventors: Andrew Leo Haynes, Auckland (NZ); Justin Jason Rosaria, Auckland (NZ)

(73) Assignee: ZinniaTek Limited, Auckland (NZ)

( * ) Notice: Subject to any disclaimer, the term of this patent is extended or adjusted under 35 U.S.C. 154(b) by 0 days.

(21) Appl. No.: 16/623,484

(22) PCT Filed: Jul. 20, 2018

(86) PCT No.: PCT/IB2018/055405
§ 371 (c)(1),
(2) Date: Dec. 17, 2019

(87) PCT Pub. No.: WO2019/016767
PCT Pub. Date: Jan. 24, 2019

(65) Prior Publication Data

US 2020/0190804 A1 Jun. 18, 2020

Related U.S. Application Data

(60) Provisional application No. 62/535,039, filed on Jul. 20, 2017.

(51) Int. Cl.
*E04D 1/30* (2006.01)
*E04D 1/00* (2006.01)
(Continued)

(52) U.S. Cl.
CPC ..... *E04D 1/30* (2013.01); *E04D 1/2918* (2019.08); *E04D 1/2949* (2019.08); *E04D 1/20* (2013.01); *E04D 1/36* (2013.01); *E04D 2001/305* (2013.01)

(58) Field of Classification Search
CPC .... E04D 1/20; E04D 1/30; E04D 1/36; E04D 2001/305; E04D 2001/3447; E04D 2001/3467; E04D 1/2918; E04D 1/2949
See application file for complete search history.

(56) References Cited

U.S. PATENT DOCUMENTS 1,549,723 A 8/1925 Mattison
2,353,259 A * 7/1944 Owen ..... E04D 1/30 52/13
(Continued)

FOREIGN PATENT DOCUMENTS

CA 2265384 A1 9/2000
DE 44 38 140 A1 5/1996
(Continued)

OTHER PUBLICATIONS

Extended European Search Report regarding European Application No. 18835126.6 dated Feb. 2, 2021, 10 pgs.

*Primary Examiner* — James M Ference
(74) *Attorney, Agent, or Firm* — Foley & Lardner LLP

(57) ABSTRACT

A ridge or hip member for a roof comprising a substantially flexible zone and a substantially rigid zone on each side of the flexible zone. The flexible zone adapted to allow the member to be bent by an installer by hand to conform the member to the ridge or hip of a roof, with the flexible zone located along a ridge or hip line of the roof. Each rigid zone being located on each side of the ridge or hip line.

44 Claims, 19 Drawing Sheets

(51) Int. Cl.
*E04D 1/20* (2006.01)
*E04D 1/36* (2006.01)

(56) References Cited

U.S. PATENT DOCUMENTS 3,760,856 A * 9/1973 Kough ..... B27M 3/00 144/345
3,943,677 A 3/1976 Carothers
4,218,857 A * 8/1980 Vallee ..... E04D 1/18 52/530
4,803,813 A * 2/1989 Fiterman ..... E04D 13/174 156/227
4,907,499 A 3/1990 James
5,060,431 A * 10/1991 MacLeod ..... F24F 7/02 52/199
5,094,041 A * 3/1992 Kasner ..... F24F 7/02 454/365
5,094,042 A * 3/1992 Freborg ..... E04D 1/20 52/57
5,271,201 A * 12/1993 Noone ..... E04D 1/20 52/420
5,304,095 A 4/1994 Morris
5,419,941 A * 5/1995 Noone ..... D06N 5/00 428/141
5,971,848 A * 10/1999 Nair ..... F24F 7/02 454/365
6,125,602 A * 10/2000 Freiborg ..... E04D 1/265 52/198
6,182,400 B1 * 2/2001 Freiborg ..... E04D 1/30 52/276
7,596,919 B1 * 10/2009 Vande Hey ..... E04D 1/20 52/314
8,256,185 B2 * 9/2012 Kirkey ..... E04D 1/26 52/748.1
9,631,368 B1 * 4/2017 Heo ..... E04D 13/004
10,036,166 B1 * 7/2018 Heo ..... E04B 1/72
2003/0196389 A1 * 10/2003 Naipawer, III ..... E04D 1/22 52/57
2004/0074156 A1 * 4/2004 Haynes ..... E04D 13/1478 52/58
2004/0187434 A1 9/2004 Podirsky
2007/0144077 A1 * 6/2007 Quaranta ..... E04D 1/30 52/43
2007/0199250 A1 * 8/2007 Haynes ..... E04D 1/36 52/58
2007/0266665 A1 * 11/2007 Todd ..... E04D 1/30 52/518
2008/0229695 A1 * 9/2008 Kalkanoglu ..... E04D 1/30 52/520
2009/0100779 A1 * 4/2009 Cluthe ..... E04D 1/20 52/543
2009/0205216 A1 * 8/2009 Ai ..... E04D 15/02 33/563
2010/0186334 A1 * 7/2010 Seem ..... E04D 1/28 52/539
2010/0239807 A1 * 9/2010 Grubka ..... E04D 1/26 428/79
2010/0275542 A1 11/2010 Ward et al.
2011/0005158 A1 * 1/2011 Kailey ..... E04D 1/30 52/518
2012/0096782 A1 * 4/2012 Railkar ..... E04D 13/174 52/198
2013/0059524 A1 * 3/2013 Henderson ..... E04D 13/174 454/365
2013/0177728 A1 * 7/2013 Grubka ..... E04D 1/30 428/43
2014/0259980 A1 * 9/2014 Jenkins ..... E04D 1/30 52/90.2
2014/0259998 A1 * 9/2014 Railkar ..... E04D 1/30 52/173.3
2014/0260000 A1 * 9/2014 Haynes ..... F28F 3/048 52/173.3
2014/0318034 A1 * 10/2014 Thagard, III ..... E04D 1/30 52/57
2015/0240496 A1 * 8/2015 Grubka ..... E04D 1/20 428/40.3
2016/0369513 A1 * 12/2016 Van Wey ..... E04D 13/176
2017/0321933 A1 * 11/2017 Kvasnicka ..... E04D 1/34
2017/0362830 A1 * 12/2017 Buckingham ..... B29C 48/12
2018/0087274 A1 * 3/2018 Grubka ..... E04D 1/30
2020/0190804 A1 * 6/2020 Haynes ..... E04D 1/30

FOREIGN PATENT DOCUMENTS

EP 1 936 057 A1 6/2008
GB 2 210 072 6/1989
WO WO-01/96687 12/2001
WO WO-2016/205205 A1 12/2016

* cited by examiner

ROOF, SIDING, OR CLADDING, OR RIDGE OR HIP MEMBER FOR A ROOF

CROSS-REFERENCE TO RELATED APPLICATION

The present application claims the benefit of, and priority to, International Patent Application No. PCT/IB2018/055405, filed Jul. 20, 2018, which claims the benefit of, and priority to U.S. Provisional Application No. 62/535,039, filed Jul. 20, 2017, the contents of which are both incorporated herein by reference in their entire entities.

FIELD OF THE INVENTION

The present invention relates to a ridge or hip member for the roof of a building, or to a roof, siding or cladding member for a roof.

BACKGROUND TO THE INVENTION

A roof comprises a membrane or members arranged to form a water tight membrane or covering over a building frame work or building surface. Sides of the roof meet at hip lines (hips) and ridge lines (ridges) of the roof. A ridge member or hip member is provided to bridge over the hip or ridge to cover and therefore make water tight the upper ends of the sides that meet at the hip or ridge of the roof. Existing hip or ridge members include sheet metal flashings that are preformed to match the pitch of a roof, and ridge tiles such as half round or third round or angled ridge tiles that are arranged along the ridge or hip with adjacent tiles overlapping.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF THE INVENTION

It is an object of the present invention to provide an improved ridge or hip member or a roof, siding or cladding member, or to at least provide the public with a useful choice.

In one aspect, the present invention broadly consists in a ridge or hip member for a roof comprising:

a substantially flexible zone and a substantially rigid zone on each side of the flexible zone, the flexible zone adapted to allow the member to be bent by an installer by hand to conform the member to the ridge or hip of a roof with the flexible zone located along a ridge or hip line of the roof and with each rigid zone located on each side of the ridge or hip line.

In some embodiments, said flexible zone is located between at least a pair of rigid zones, or said flexible zone is flanked by a pair of substantially rigid zones.

In some embodiments, the flexible zone extends from a leading edge of said member to a trailing edge (optionally said flexible zone being oriented to extend in a direction along a longitudinal axis of said member).

In some embodiments, the substantially flexible zone is relatively more flexible than the substantially rigid zone on each side of the flexible zone (optionally in a transverse direction of the ridge or hip member).

In some embodiments, the substantially rigid zone each side of the flexible zone is relatively more rigid than the substantially flexible zone (optionally in a transverse direction of the ridge or hip member).

In some embodiments, the flexible zone extends from an overlapping region to an underlapping region.

In some embodiments, the member comprises at least a first engagement feature, and at least a second engagement feature.

In some embodiments, the first engagement is adapted to engage with an engagement feature of an adjacent ridge or hip member to substantially locate or co-locate or set the relative position of the adjacent member and/or provide for a connection between said ridge or hip member and said adjacent member.

In some embodiments, the first engagement feature is configured to engage with a second engagement feature of an adjacent member.

In some embodiments, the second engagement is adapted to engage with an engagement feature of an adjacent ridge or hip member to substantially locate or co-locate or set the relative position of the adjacent member and/or provide for a connection between said ridge or hip member and said adjacent member.

In some embodiments, the second engagement feature is configured to engage with a first engagement feature of an adjacent member.

In some embodiments, said first engagement feature is located on an upper surface of an underlapping region and said second engagement feature is located on a lower surface of an overlapping region.

In some embodiments, said first engagement feature and second engagement features allow for weathertight sealing between said member and an adjacent member.

In some embodiments, said first engagement feature is a recess, or groove (optionally in the underlapping region) and said second engagement feature is a projection (optionally extending from a lower surface of the overlapping region), wherein the recess is adapted to receive the projection of an adjacent and/or overlapping ridge or hip member to substantially locate or co-locate or set the relative position the adjacent members.

In some embodiments, said first engagement feature is a projection (optionally extending from an upper surface of the underlapping region), and said second engagement feature is a recess groove (optionally in the overlapping region) wherein the recess is adapted to receive the projection of an adjacent and/or overlapping ridge or hip member to substantially locate or co-locate or set the relative position the adjacent members.

In some embodiments, said projection is dimensioned, and/or sized and shaped, so as to be prevented from engagement with and/or a seating within at least one fluid channel.

In some embodiments, at least one fluid channel is dimensioned, and/or sized and shaped, so as to be prevented from engagement with and/or a seating within said projection.

In some embodiments, in use when said member is slid upwards with respect to an already installed adjacent member during installation said projection passes over said at least one fluid channel without engaging (or is unable to engage) said at least one fluid channel before reaching said recess and to become engaged with said recess.

In some embodiments, at least one fluid channel is closer to (or more toward) a leading edge of said member when installed or a leading edge of said underlapping region than said recess.

In some embodiments, the recess is an alignment channel extending lateral to a roof ridge or hip direction.

In some embodiments, the projection extends lateral to the roof ridge or hip direction, and/or wherein the member comprises a plurality of projections extending from a lower surface of the overlapping region spaced apart in a direction lateral to the roof ridge or hip direction, the recess adapted to receive the plurality of projections of an adjacent and/or overlapping ridge or hip member.

In some embodiments, the projection has a width less than a width of the recess to allow movement of the member relative to an adjacent member along the direction of the ridge or hip of the roof.

In some embodiments, said movement allows for variance in rotational alignment of said member, with said adjacent member.

In some embodiments, the member comprises a said projection in the rigid zones and is without a said projection in the flexible zone.

In some embodiments, one or both of an upper surface of an underlapping region and a lower surface of an overlapping region comprise a glue or adhesive strip or region, including but not limited to pressure sensitive adhesives.

In some embodiments, the member comprises an overlapping region and an underlapping region, the underlapping region comprising at least one fluid channel in an upper surface of the underlapping region and extending across the width of the member.

In some embodiments, said at least one fluid channel is configured to direct fluid received between the overlapping and underlapping regions of adjacent members down the roof surface away from the ridge or hip line of the roof.

In some embodiments, the fluid channel extends laterally with respect to the ridge or hip line of the roof.

In some embodiments, the member comprises a plurality of said fluid channels spaced apart along a roof ridge or hip direction of the member.

In some embodiments, the plurality of fluid channels comprises at least two spaced apart groups of said fluid channels, each group comprising at least two said fluid channels.

In some embodiments, a first fluid channel nearest the overlapping region has a greater channel depth and/or width than other said fluid channels spaced further from the overlapping region.

In some embodiments, the fluid channel has a depth of about 3 mm, and/or a width of about 4 mm.

In some embodiments, the first fluid channel has a depth of about 3 mm and/or a width of about 4 mm, and other fluid channels have a depth of about 2 mm and/or a width of about 3 mm.

In some embodiments, the at least one fluid channel has a wavy path, and/or substantially sinusoidal path, and/or is of a shape or configuration which is not engageable by said projection.

In some embodiments, the wavy path has a pitch of about 5 mm and an amplitude of about 25 mm.

In some embodiments, the flexible zone spans at least 10% of the width and/or length of the member straddling the ridge or hip line of the roof.

In some embodiments, the flexible zone spans at least 15%, or at least 20% of the width and/or length of the member.

In some embodiments, the flexible zone presents a minimum bend radius of at least 20 mm, or at least 25 mm, or at least 30 mm, or at least 35 mm, or at least 40 mm, or at least 45 mm, or at least 50 mm.

In some embodiments, the flexible zone is more flexible than the rigid zones by comprising one or more of:

- different geometry and/or material in the flexible zone and the rigid zones
- a concertina-type section in the flexible zone
- an area of variable thickness in the flexible zone relative to the rigid zones
- a variation in material properties and/or material in said flexible zone relative to the rigid zones
- a reduced thickness in said flexible zone relative to the rigid zones
- a reinforced polymer in said rigid zone and/or an unreinforced polymer in said flexible zone
- a polymer of a first stiffness in said flexible zone, and a polymer of a second stiffness in said rigid zone, wherein said second stiffness is greater than said first stiffness.

In some embodiments, said flexible zone has a minimum bend radius corresponding with a maximum bendable state of said flexible zone.

In some embodiments, said maximum bendable state is defined by engagement of one or more features of the flexible zone (optionally said features are a plurality of ribs extending in a longitudinal direction of the member or in the direction of a ridge or hip of the roof).

In some embodiments, the flexible zone has a longitudinal stiffness (or stiffness in a direction along the ridge or hip line) similar or substantially the same as a longitudinal stiffness (or stiffness in a direction along the ridge or hip line) of the rigid zone.

In some embodiments, the flexible zone has a stiffness in a direction transverse to the longitudinal direction (or in the direction of a ridge or hip of the roof) substantially less that the stiffness of the rigid zone in the direction transverse to the longitudinal direction.

In some embodiments, the member is anisotropic.

In some embodiments, the member has a first elastic modulus or first stiffness in a width direction and a second elastic modulus or second stiffness in a length direction, the first elastic modulus or first stiffness less than the second elastic modulus or second stiffness.

In some embodiments, when bent or installed the rigid zones stay substantially planar.

In some embodiments, when bent or installed, deflection of said member is of the flexible zone.

In some embodiments, the flexible zone comprises a plurality of spaced apart grooves in a lower surface of the member, the grooves arranged side-by-side across the width of the member and extending in a length direction of the member to be arranged along the ridge or hip line of the roof.

In some embodiments, the member comprises an overlapping region and an underlapping region, and the grooves extend to an edge, or close to an edge, of the member in the underlapping region.

In some embodiments, the depth of the grooves at the edge of the member in the underlapping region is less than the depth of the grooves along a remainder of the grooves.

In some embodiments, the member comprises an overlapping region and an underlapping region, and wherein the grooves do not extend fully to an edge of the member in the overlapping region.

In some embodiments, wherein the grooves have a depth of 1 mm and/or a width of 5 mm, optionally 3 mm.

In some embodiments, the member has a first thickness in the rigid zones and a second thickness in the flexible zone, the first thickness greater than the second thickness.

In some embodiments, the thickness of the member in the flexible zone is less than the thickness of the member in the rigid zones.

In some embodiments, the thickness of the flexible zone is less than the thickness of the rigid zones for substantially the full width of the flexible zone.

In some embodiments, said flexible zone is configured to bend to provide for an arc shaped profile across the flexible zone (e.g. in a direction to extend substantially over a ridge or hip of the roof to be clad).

In some embodiments, said flexible zone is configured to bend substantially evenly and/or substantially uniformly across its width.

In some embodiments, said flexible zone is configured to substantially bend evenly and/or substantially uniformly across its width to provide for substantially constant radius of curvature across said flexible zone when bent.

In some embodiments, said rigid zone is stiffer along an axis (optionally a transverse axis and/or from a leading edge of the member to a trailing edge of the member) than an axis (optionally a transverse axis and/or from a leading edge of the member to a trailing edge of the member) of said flexible zone.

In some embodiments, the flexible zone is stiffer along a first axis (optionally a longitudinal axis, or an axis extending from a leading edge of the member to a trailing edge of the member) than a second axis (optionally a transverse axis or an axis extending parallel to one or more of: a leading edge of the member to a trailing edge of the member) to allow the member to be bent along said second axis while resisting bending in the first axis.

In some embodiments, said flexible zone comprises a flexible region to provide for said flexibility, said flexible region located on an underside of said ridge or hip member.

In some embodiments, said flexible region does not extend through to an upper surface of the ridge or hip member so as to not be visible from said upper surface.

In some embodiments, an exposed surface of the ridge or hip member is substantially flat, or said exposed surface comprises surface decoration or patterning or texturing to emulate natural or man-made roofing materials such as timber shakes or shingles, asphalt shingles.

In some embodiments, the flexible zone comprises at least a first layer and at least a second layer, said first layer at least in part defining the underside of the flexible zone of the ridge or hip member, and said second layer defining at least in part an upper surface of the flexible zone of the ridge or hip member to be exposed in use; and wherein the first layer comprises said flexible region, and wherein said second layer is a substantially flat or planar surface, or of a substantially uniform thickness.

In some embodiments, said second layer is configured to stretch to accommodate a bending or deflection of said flexible region of said first layer while still remaining substantially flat, and/or retaining a profile of the upper layer, such as of an exposed surface optionally said exposed surface comprises decoration or patterning or texturing to emulate natural or man-made roofing materials such as timber shakes or shingles, asphalt shingles.

In some embodiments, said second layer is configured to stretch in a direction along a length or width to accommodate a bending or deflection of said flexible section of said first layer while still remaining substantially flat; and/or wherein said first layer is configured to compress in a direction along a length or width on bending or deflecting of said member.

In some embodiments, the flexible zone comprises a first material and the ridge zones comprise a second material, wherein the first material is more flexible than the second material.

In some embodiments, the member comprises at least two material layers, a first layer comprising a first material, and a second layer comprising a second material, and wherein the first material is more flexible than the second material, and wherein in the flexible zone a thickness of the first layer is greater than a thickness of the second layer, and/or in each rigid zone a thickness of the second layer is greater than a thickness of the first layer.

In some embodiments, the member comprises a first material and a second material, wherein the first material is more flexible than the second material, and wherein the flexible zone includes more of the first material than the second material, and/or wherein the rigid zones include more of the second material than the first material.

In some embodiments, the flexible zone is without the second material, and/or wherein the rigid zones are without the first material.

In some embodiments, an amount of the first material in each rigid zone reduces across the width of the rigid zone from the flexible zone towards an edge of the member, and/or wherein an amount of the first material increases in the flexible zone from each said rigid zone towards a centre of the flexible zone.

In some embodiments, the first material is or comprises one or more elastomers.

In some embodiments, the first material comprises at least one polymer and a first loading level of reinforcing and/or filler, and the second material comprises at least one polymer and a second loading level of reinforcing and/or filler, and wherein the first loading level is less than the second loading level so that the first material is more flexible than the second material.

In some embodiments, the first material and the second material each comprise the same polymer or polymers, or wherein the polymer or polymers of the first material are different to the polymer or polymers of the second material optionally the second material comprises different physical properties to the first material for example different flexibility, different softness, or different deformation characteristics.

In some embodiments, the member comprises a plurality of ribs on the lower surface of the rigid zones.

In some embodiments, the member comprises a plurality of ribs on the lower surface of the member.

In some embodiments, said ribs define cavities between the ribs, the ribs providing strength to the rigid zones.

In some embodiments, said ribs extend in one or more of a first axis (optionally a longitudinal axis or an axis extending from a leading edge of the member to a trailing edge of the member) and a second axis (optionally a transverse axis, or an axis extending parallel to one or more of: a leading edge of the member to a trailing edge of the member).

In some embodiments, said ribs extend in one or more of:

a first axis (optionally disposed at an angle to longitudinal axis or disposed at an angle to an axis extending from a leading edge of the member to a trailing edge of the member)

a second axis (optionally disposed at an angle to a transverse axis, or an axis extending or disposed at an angle to one or more of: a leading edge of the member to a trailing edge of the member)

a third axis (optionally parallel to one or more cutting guides).

a fourth axis (optionally perpendicular to one or more cutting guides

In some embodiments, the ribs are located between adjacent cutting guides.

In some embodiments, the said ribs comprise at least a first set of ribs, and at least a second set of ribs.

In some embodiments, said ribs are arranged in a criss-crossing or intersecting type pattern.

In some embodiments, the first set of ribs are arranged substantially perpendicular to the second set of ribs.

In some embodiments, the ribs are arranged as a pattern to cover a substantial portion of the underside of the ridge or hip member (optionally the ribs are arranged in a pattern to cover a substantial portion or an entire underside of the exposed region, optionally the ribs are arranged in a pattern to cover a substantial portion or an entire underside of the underlapping region).

In some embodiments, the ribs provide a stiffness or relative rigidity to the ridge or hip member in a direction extending from a central axis or longitudinal axis of the ridge or hip member towards one or more leading corner(s) of the ridge or hip member.

In some embodiments, the member comprises an overlapping region and an underlapping region, and width and/or length of the member in the underlapping region is less than the length of the member in the overlapping region such that edges of the member in the underlapping region are obscured from view by an adjacent overlapping member.

In some embodiments, the member comprises a step in an upper surface at a boundary of an underlapping region, so that an upper surface of the underlapping region is elevated above an upper surface of the member adjacent to said boundary of said underlapping region configured to be exposed in use.

In some embodiments, the step is angled away from the upper surface of the member adjacent to said boundary of said underlapping region configured to be exposed in use towards the upper surface of the underlapping region.

In some embodiments, the upper surface of the underlapping region slopes relative to a lower surface of the underlapping region away from the overlapping region.

In some embodiments, the upper surface of the underlapping region comprises a ramped region, said ramped region having a positive gradient (relative to a lower surface of the underlapping region) in a direction away from a trailing edge of the member towards said leading edge.

In some embodiments, said ramped region is the majority of the length of the upper surface of the underlapping region.

In some embodiments, in said underlapping region said member is tapered from a relatively thinner end at or closer to a trailing edge of the member to a relatively thicker end closer to a leading edge of the member.

In some embodiments, the ridge or hip member comprises at least one fastening zone, which fasteners may be provided to or pass therethrough, so as secure or provide for a securement of the member to a building surface and/or an adjacent member.

In some embodiments, the at least one fastening zone is located within the or each rigid zone.

In some embodiments, the at least one fastening zone is located in the underlapping region of the ridge or hip member.

In some embodiments, the member comprises at least one flexible or hinged portion, optionally the at least one flexible or hinged portion allows for flexibility or hinging about a substantially transverse axis of the member.

In some embodiments, the flexible or hinged portion located in each rigid zone

In some embodiments, the fastening zone is located on one or both sides of a flexible or hinged portion located in each rigid zone.

In some embodiments, the flexible or hinged portion allows for a relative flexing or hinging of a first portion of each rigid zone relative to a second portion of each rigid zone.

In some embodiments, the first portion of each rigid zone is located nearer or more toward a leading edge of the ridge or hip member than the second portion of each rigid zone In some embodiments, the flexing or hinging isolates and/or attenuates and/or prevents the transmission of forces from the first portion of each rigid zone relative to a second portion of each rigid zone.

In some embodiments, the fastening zone is located on one or both sides of a recess located in each rigid zone (optionally the recess acts as said hinged portion).

In some embodiments, the at least one fastening zone is a pair of fastening zones, each fastening zone located in each rigid zone.

In some embodiments, the or each fastening zone comprises two sub-sections disposed on either side of a recess.

In some embodiments, the fastening zone comprises at least one rib.

In some embodiments, the fastening zone is stiffer than the remainder of the rigid zone (other than the flexible or hinging portion).

In some embodiments, the at least one rib comprises at least a first set of ribs and a second set of ribs.

In some embodiments, the at least one rib is arranged in a criss-cross or intersecting type arranged pattern.

In some embodiments, the first set of ribs are arranged substantially perpendicular to the second set of ribs.

In some embodiments, at least one cavity is formed between the first set of ribs and the second set of ribs.

In some embodiments, the cavity is configured to be receivable of at least one fastener.

In some embodiments, the cross sectional area of the cavity is configured to be smaller or the same size as the cross-sectional area of at least one fastener In some embodiments, the distance between the first set of ribs and the second set of ribs, and/or at least one dimension of the cavity is smaller or the same size as the largest dimension of at least one fastener.

In some embodiments, the ribs are configured to engage with a head and/or portion of the fastener when installed, to distribute a fastening force over the fastening zone.

In some embodiments, the underlapping region and/or the fastening zone comprises an area of increased thickness compared to a remainder of the member through which fasteners may be provided to secure the member to a building surface.

In some embodiments, the underlapping region comprises an area of increased thickness compared to a remainder of the member through which fasteners may be provided to secure the member to a building surface.

In some embodiments, an underlapping region of the member comprises an indicia corresponding with the location for receipt of a fastener to secure the member to a building surface.

In some embodiments, the member comprises a region for receipt of a fastener to secure the member to a building surface, wherein said region comprises: an indicia, and/or is a reinforced area.

In some embodiments, said reinforced area is provided by a reinforcing layer, or the addition of reinforcing to said reinforced area.

In some embodiments, the ridge or hip member comprises at least one recess along a leading edge (optionally parallel to said leading edge) in the or each rigid zone.

In some embodiments, the ridge or hip member is configured to receive at least one adhesive portion and/or line and/or bead on one or both sides (adjacent) of the at least one recess, said at least one adhesive portion and/or line and/or bead configured to engage with an adjacent member when installed (optionally to create a substantially waterproof seal)

In some embodiments, the member comprises at least one edge feature, the edge feature being located at, or near, or along one or more of: a side or outer edge and/or the leading edge, and/or the trailing edge, optionally the edge feature is substantially parallel to said edge.

In some embodiments, the edge feature is one or more of a: raised wall, or recess.

In some embodiments, the edge feature provides for a barrier to the underside of the ridge or hip member.

In some embodiments, the edge feature provides for a visual barrier, such that when installed the underside of the member is not visible from the side or outer edge of the member.

In some embodiments, said edge feature is configured to engage with the exposed surface of an adjacent tile when installed.

In some embodiments, the edge feature is configured to provide a continuous face of a side or outer edge of the member.

In some embodiments, the ridge or hip member comprises at least one cutting guide.

In some embodiments, the cutting guide is located on an underside of the exposed region of the ridge or hip member.

In some embodiments, the at least one cutting guide extends in a direction along an axis or in a direction, or provides for a cutting guide pathway, that extends from the leading edge of the ridge or hip member towards or to one or more outer or side edges of the member.

In some embodiments, the at least one cutting guide comprises one or more of:

a thinned region a slot a region of reduced member material thickness.

In some embodiments, the ridge or hip member comprises a raised wall or an edge feature located along at least one side and/or around said at least one cutting guide (optionally along an inner side of the at least one cutting guide).

In some embodiments, the edge feature extends in a direction away from an upper surface of the member and/or from the upper surface of said member towards a building surface to which the member is attached, and/or an adjacent member.

In some embodiments, the raised wall or edge feature provides for a barrier to the underside of the ridge or hip member.

In some embodiments, the raised wall or edge feature provides for a visual barrier, such that when installed the underside of the member is not visible.

In some embodiments, said raised wall or edge feature is configured to engage with the exposed surface of an adjacent tile or member when installed.

In some embodiments, the raised wall or edge feature is configured to provide a continuous face of an edge of the ridge or hip member when the ridge or hip member is cut along said cutting guide.

In some embodiments, the at least one cutting guide is configured to allow removal of at least one (optionally a pair of) leading corner(s), or other portions, of the ridge or hip module.

In some embodiments, the at least one cutting guide comprises a first cutting guide or a first set of cutting guides and a second cutting guide or a second set of cutting guides.

In some embodiments, the first set of cutting guides extend in a direction along an axis or in a direction, or provides for a cutting guide pathway, that extends from the leading edge of the ridge or hip member towards or to a first outer or side edge of the member.

In some embodiments, the second set of cutting guides extend in a direction along an axis or in a direction, or provides for a cutting guide pathway, that extends from the leading edge of the ridge or hip member towards or to a second outer or side edge of the member.

In some embodiments, each cutting guide in the first set of cutting guides has a corresponding cutting guide in the second set of cutting guides, optionally, said each cutting guide and corresponding cutting guide being a mirror image of each other each other.

In some embodiments, each of the at least one cutting guides (or corresponding pairs of cutting guides in the first and second sets of cutting guides) corresponds with a particular roof pitch angle.

In some embodiments, the second set of cutting guides is a mirror image of the first set of cutting guides about a longitudinal or central axis.

In some embodiments, the cutting guide is of a linear cutting guide pathway or is of a non-linear (e.g. curved) cutting guide pathway.

In some embodiments, the at least one cutting guide is located within each rigid zone In some embodiments, the at least one cutting guide comprises a cutting guide or set of cutting guides in each rigid zone.

In some embodiments, the cutting guide or set of cutting guides in each rigid zone is a mirror image of the at least one cutting guide located in the other of each rigid zone along a central or longitudinal axis.

In some embodiments, the at least one cutting guide is extends from a leading edge of the ridge or hip member across part of the flexible zone, and at least part of the rigid zone to an outer edge of the ridge or hip member In some embodiments, the at least one cutting guide is along an axis from the leading edge of the ridge or hip member towards an outer edge of the ridge or hip member In some embodiments, the at least one cutting guide, or each set of cutting guides, comprises one, or two, or three or more cutting guides.

In some embodiments, each of the one or more cutting guides is disposed at a different angle from each of the other one or more cutting guides (optionally a different angle to each cutting guide in each set of cutting guides).

In some embodiments, each of the one or more cutting guides is disposed at a different angle from one or more of:

a longitudinal axis of the ridge or hip member a transverse axis of the ridge or hip member a leading edge the ridge or hip member a trailing edge the ridge or hip member.

In some embodiments, the member is formed from or comprises at least one polymer and comprises:

reinforcing and/or filler in the polymer in the rigid zones and no reinforcing or filler in the polymer in the flexible zone, or reinforcing and/or filler in the polymer, the member having a first loading level of reinforcing or filler in the flexible zone and a second loading level of reinforcing or filler in the rigid zones, and wherein the first loading level is less than the second loading level.

In some embodiments, the second loading level is at least twice the first loading level.

In some embodiments, the second loading level of the filler or reinforcing or both is at least 40%, or 50%, or 60%, or 70%, or 80%, or 90% w/w.

In some embodiments, the member is formed from or comprises at least one polymer and reinforcing and/or filler in the polymer, and wherein the reinforcing and/or filler is aligned in a length direction of the member to be aligned with the direction of the ridge or hip line of the roof.

In some embodiments, the filler comprises one or more of the following: talc, calcium carbonate, mica, silica, kaolin, calcium sulphate, magnesium hydroxide, stabilizers, dolomite.

In some embodiments, the reinforcement comprises one or more of the following: glass fibres, glass beads, glass flakes, flax, cellulose, wood fibres, wood flour, cotton, sawdust, inorganic fibres, polymer fibres, polymer scrim, polymer knit, polymer weave, aramids, ceramics, carbon fibres In some embodiments, the second elastic modulus is between 1.5 times and 20 times the first elastic modulus, optionally the second elastic modulus is at least twice the first elastic modulus.

In some embodiments, the member is formed from one or more polymers.

In some embodiments, one or polymers comprise one or more elastomers.

In some embodiments, the one or more elastomers are selected from thermoplastic elastomers.

In some embodiments, the one or more polymers are selected from polystyrene (GPPS), polyethylene terephthalate (PET), polyester methacrylate (PEM), high impact polystyrene (HIPS), acrylonitrile butadiene styrene (ABS), polyvinyl chloride (PVC), polyurethanes (PU), polyethylene (PE) including homopolymer, copolymer, block copolymer and terpolymer forms, polylactic acid (PLA), nylon (PA), acrylics (PMMA), high density polyethylene (HDPE), low density polyethylene (LDPE), linear low density polyethylene (LLDPE), medium density polyethylene (MDPE), cross linked polyethylene (PEX), thermoplastic elastomer (TPE), thermoplastic polyolefin (TPO), thermoplastic rubber (TPR), polypropylene (PP), including homopolymer and copolymer forms, polybutylene terephthalate (PBT), styrene-acrylonitrile resin (SAN), ethylene tetrafluoroethylene (ETFE), vinyl, methacrylate copolymers, foamed polymer, polycarbonates, and combinations thereof.

In some embodiments, said member comprises an underlapping region configured to be covered in use by an overlapping region of an adjacent member.

In some embodiments, said underlapping region is located at a trailing edge of said member.

In some embodiments, said member comprises an overlapping region configured to cover in use (or when installed) an underlapping region of an adjacent member.

In some embodiments, said overlapping region is located at a leading edge of said member.

In some embodiments, an upper surface of said member comprises an exposed surface.

In some embodiments, said member is longer in a direction from a leading edge to a trailing edge, said direction being a longitudinal axis In some embodiments, said longitudinal axis is to be oriented when installed in a direction along a ridge or hip line.

In some embodiments, wherein a length of the member is in the same direction as, or in a transverse direction to a ridge or hip line when installed In some embodiments, a width of the member is in the same direction as, or in a transverse direction to a ridge or hip line when installed.

In some embodiments, the member comprises at least two layers of polymeric material, wherein the layers are of the same or different polymeric material. In some embodiments, at least one material has high UV resistance.

In some embodiments, the member or the polymer layers can be coloured or comprise a blend of colours. In some embodiments, the polymer on the outer layer of the member can be manufactured to mimic traditional roofing products.

In some embodiments, the member is manufactured by a continuous forming process, for example as described in International patent publication WO2016/088026. Alternatively in some embodiments the member is formed by injection moulding, die casting, extrusion, pressing, or any other suitable known forming process.

In another aspect there is provided a ridge or hip member for a roof comprising:

a substantially flexible zone and a substantially rigid zone on each side of the flexible zone, the flexible zone adapted to allow the member to be bent by an installer by hand to conform the member to the ridge or hip of a roof with the flexible zone located along a ridge or hip line of the roof and with each rigid zone located on each side of the ridge or hip line.

In some embodiments, said flexible zone is located between at least a pair of rigid zones, or said flexible zone is flanked by a pair of substantially rigid zones.

In some embodiments, the flexible zone extends from a leading edge of said member to a trailing edge (optionally said flexible zone being oriented to extend in a direction along a longitudinal axis of said member).

In some embodiments, the substantially flexible zone is relatively more flexible than the substantially rigid zone on each side of the flexible zone (optionally in a transverse direction of the ridge or hip member).

In some embodiments, the substantially rigid zone each side of the flexible zone is relatively more rigid than the substantially flexible zone (optionally in a transverse direction of the ridge or hip member).

In some embodiments, the member comprises at least a first engagement feature, and at least a second engagement feature, optionally, the first engagement is adapted to engage with an engagement feature of an adjacent ridge or hip member to substantially locate or co-locate or set the relative position of the adjacent member and/or provide for a connection between said ridge or hip member and said adjacent member, optionally, the first engagement feature is configured to engage with a second engagement feature of an adjacent member.

In some embodiments, the second engagement is adapted to engage with an engagement feature of an adjacent ridge or hip member to substantially locate or co-locate or set the relative position of the adjacent member and/or provide for a connection between said ridge or hip member and said adjacent member, optionally, the second engagement feature is configured to engage with a first engagement feature of an adjacent member.

In some embodiments, the member comprising an overlapping region and an underlapping region, the underlapping region comprising at least one fluid channel in an upper surface of the underlapping region and extending across the width of the member, optionally, said at least one fluid channel is configured to direct fluid received between the overlapping and underlapping regions of adjacent members down the roof surface away from the ridge or hip line of the roof, optionally, the fluid channel extends laterally with respect to the ridge or hip line of the roof.

In some embodiments, the flexible zone is more flexible than the rigid zones by comprising one or more of:

- different geometry and/or material in the flexible zone and the rigid zones
- a concertina-type section in the flexible zone
- an area of variable thickness in the flexible zone relative to the rigid zones
- a variation in material properties and/or material in said flexible zone relative to the rigid zones
- a reduced thickness in said flexible zone relative to the rigid zones
- a reinforced polymer in said rigid zone and/or an unreinforced polymer in said flexible zone
- a polymer of a first stiffness in said flexible zone, and a polymer of a second stiffness in said rigid zone, wherein said second stiffness is greater than said first stiffness.

In some embodiments, said flexible zone has a minimum bend radius corresponding with a maximum bendable state of said flexible zone, optionally, said maximum bendable state is defined by engagement of one or more features of the flexible zone (optionally said features are a plurality of ribs extending in a longitudinal direction of the member or in the direction of a ridge or hip of the roof).

In some embodiments, the flexible zone has a longitudinal stiffness (or stiffness in a direction along the ridge or hip line) similar or substantially the same as a longitudinal stiffness (or stiffness in a direction along the ridge or hip line) of the rigid zone.

In some embodiments, the flexible zone has a stiffness in a direction transverse to the longitudinal direction (or in the direction of a ridge or hip of the roof) substantially less that the stiffness of the rigid zone in the direction transverse to the longitudinal direction.

In some embodiments, wherein the member has a first elastic modulus or first stiffness in a width direction and a second elastic modulus or second stiffness in a length direction, the first elastic modulus or first stiffness less than the second elastic modulus or second stiffness.

In some embodiments, when bent or installed the rigid zones stay substantially planar.

In some embodiments, when bent or installed, deflection of said member is of the flexible zone.

In some embodiments, the flexible zone comprises a plurality of spaced apart grooves in a lower surface of the member, the grooves arranged side-by-side across the width of the member and extending in a length direction of the member to be arranged along the ridge or hip line of the roof.

In some embodiments, the member has a first thickness in the rigid zones and a second thickness in the flexible zone, the first thickness greater than the second thickness.

In some embodiments, the thickness of the member in the flexible zone is less than the thickness of the member in the rigid zones.

In some embodiments, the thickness of the flexible zone is less than the thickness of the rigid zones for substantially the full width of the flexible zone.

In some embodiments, said flexible zone is configured to bend to provide for an arc shaped profile across the flexible zone (e.g. in a direction to extend substantially over a ridge or hip of the roof to be clad).

In some embodiments, said flexible zone is configured to bend substantially evenly and/or substantially uniformly across its width.

In some embodiments, wherein said flexible zone is configured to substantially bend evenly and/or substantially uniformly across its width to provide for substantially constant radius of curvature across said flexible zone when bent.

In some embodiments, said rigid zone is stiffer along an axis (optionally a transverse axis and/or from a leading edge of the member to a trailing edge of the member) than an axis (optionally a transverse axis and/or from a leading edge of the member to a trailing edge of the member) of said flexible zone.

In some embodiments, the flexible zone is stiffer along a first axis (optionally a longitudinal axis, or an axis extending from a leading edge of the member to a trailing edge of the member) than a second axis (optionally a transverse axis or an axis extending parallel to one or more of: a leading edge of the member to a trailing edge of the member) to allow the member to be bent along said second axis while resisting bending in the first axis.

In some embodiments, said flexible zone comprises a flexible region to provide for said flexibility, said flexible region located on an underside of said ridge or hip member In some embodiments, said flexible region does not extend through to an upper surface of the ridge or hip member so as to not be visible from said upper surface In some embodiments, an exposed surface of the ridge or hip member is substantially flat, or said exposed surface comprises surface decoration or patterning or texturing to emulate natural or man-made roofing materials such as timber shakes or shingles, asphalt shingles.

In some embodiments, the flexible zone comprises at least a first layer and at least a second layer, said first layer at least in part defining the underside of the flexible zone of the ridge or hip member, and said second layer defining at least in part an upper surface of the flexible zone of the ridge or hip member to be exposed in use; and wherein the first layer comprises said flexible region, and wherein said second layer is a substantially flat or planar surface, or of a substantially uniform thickness, optionally, said second layer is configured to stretch to accommodate a bending or deflection of said flexible region of said first layer while still remaining substantially flat, and/or retaining a profile of the upper layer, such as of an exposed surface optionally said exposed surface comprises decoration or patterning or texturing to emulate natural or man-made roofing materials such as timber shakes or shingles, asphalt shingles.

In some embodiments, wherein the member comprises a plurality of ribs on the lower surface, optionally, of the rigid zones, optionally, said ribs define cavities between the ribs, the ribs providing strength to the rigid zones.

In some embodiments, the upper surface of the underlapping region comprises a ramped region, said ramped region having a positive gradient (relative to a lower surface of the underlapping region) in a direction away from a trailing edge of the member towards said leading edge.

In some embodiments, the ridge or hip member comprises at least one fastening zone, which fasteners may be provided to or pass therethrough, so as secure or provide for a securement of the member to a building surface and/or an adjacent member.

In some embodiments, the at least one fastening zone is located within the or each (relatively) rigid zone.

In some embodiments, the at least one fastening zone is located in the underlapping region of the ridge or hip member.

In some embodiments, the member comprises at least one flexible or hinged portion, optionally the at least one flexible or hinged portion allows for flexibility or hinging about a substantially transverse axis of the member.

In some embodiments, the flexing or hinging isolates and/or attenuates and/or prevents the transmission of forces from the first portion of each rigid zone relative to a second portion of each rigid zone.

In some embodiments, the underlapping region and/or the fastening zone comprises an area of increased thickness compared to a remainder of the member through which fasteners may be provided to secure the member to a building surface.

In some embodiments, the member comprises at least one edge feature, the edge feature being located at, or near, or along one or more of: a side or outer edge and/or the leading edge, and/or the trailing edge, optionally the edge feature is substantially parallel to said edge, optionally, the edge feature is one or more of a: raised wall, or recess.

In some embodiments, the edge feature provides for a barrier to the underside of the ridge or hip member, and/or the edge feature provides for a visual barrier, such that when installed the underside of the member is not visible from the side or outer edge of the member.

In some embodiments, the ridge or hip member comprises at least one cutting guide.

In some embodiments, the cutting guide is located on an underside of the exposed region of the ridge or hip member.

In some embodiments, the at least one cutting guide comprises one or more of:

a thinned region a slot a region of reduced member material thickness.

In some embodiments, the member comprises a raised wall or an edge feature located along at least one side and/or around said at least one cutting guide (optionally along an inner side of the at least one cutting guide), optionally, the edge feature extends in a direction away from an upper surface of the member and/or from the upper surface of said member towards a building surface to which the member is attached, and/or an adjacent member.

In some embodiments, the raised wall or edge feature provides for a barrier to the underside of the ridge or hip member, and/or wherein the raised wall or edge feature provides for a visual barrier, such that when installed the underside of the member is not visible.

In some embodiments, the at least one cutting guide is configured to allow removal of at least one (optionally a pair of) leading corner(s), or other portions, of the ridge or hip module.

In some embodiments, the at least one cutting guide comprises a first cutting guide or a first set of cutting guides and a second cutting guide or a second set of cutting guides, optionally, the second set of cutting guides is a mirror image of the first set of cutting guides about a longitudinal or central axis.

In some embodiments, the first set of cutting guides extend in a direction along an axis or in a direction, or provides for a cutting guide pathway, that extends from the leading edge of the ridge or hip member towards or to a first outer or side edge of the member, and wherein the second set of cutting guides extend in a direction along an axis or in a direction, or provides for a cutting guide pathway, that extends from the leading edge of the ridge or hip member towards or to a second outer or side edge of the member.

In some embodiments, each cutting guide in the first set of cutting guides has a corresponding cutting guide in the second set of cutting guides, optionally, said each cutting guide and corresponding cutting guide being a mirror image of each other each other.

In some embodiments, wherein each of the at least one cutting guides (or corresponding pairs of cutting guides in the first and second sets of cutting guides) corresponds with a particular roof pitch angle.

In some embodiments, the cutting guide is of a linear cutting guide pathway or is of a non-linear (e.g. curved) cutting guide pathway.

In some embodiments, the at least one cutting guide is extends from a leading edge of the ridge or hip member across part of the flexible zone, and at least part of the rigid zone to an outer edge of the ridge or hip member.

In another aspect there is provided ridge or hip module comprising a plurality of formed regions corresponding to said ridge or hip members as defined in above aspects.

In some embodiments, said module is provided with said edge feature, and each member of said module further comprises said cutting guide portions.

In some embodiments, a member portion is separable from the module to provide for a resized module.

In another aspect there is provided a roofing, cladding or siding member comprising:

an upper surface comprising an exposed surface or region, an underlapping region configured to be covered in use by an overlapping region of an adjacent member, at least one cutting guide configured to allow for the resizing of the member and/or the removal of a portion of the member.

In some embodiments, the cutting guide is located on an underside of the exposed region of the member.

In some embodiments, the at least one cutting guide extends in a direction along an axis or in a direction, or provides for a cutting guide pathway, that extends from the leading edge of the member towards or to one or more outer or side edges of the member.

In some embodiments, the at least one cutting guide comprises one or more of:

a thinned region a slot a region of reduced member material thickness.

In some embodiments, the member comprises a raised wall or an edge feature located along at least one side and/or around said at least one cutting guide (optionally along an inner side of the at least one cutting guide), optionally, the edge feature extends in a direction away from an upper surface of the member and/or from the upper surface of said member towards a building surface to which the member is attached, and/or an adjacent member.

In some embodiments, the raised wall or edge feature provides for a barrier to the underside of the member, and/or wherein the raised wall or edge feature provides for a visual barrier, such that when installed the underside of the member is not visible.

In some embodiments, the at least one cutting guide is configured to allow removal of at least one (optionally a pair of) leading corner(s), or other portions, of the member.

In some embodiments, the at least one cutting guide comprises a first cutting guide or a first set of cutting guides and a second cutting guide or a second set of cutting guides, optionally, the second set of cutting guides is a mirror image of the first set of cutting guides about a longitudinal or central axis.

In some embodiments, the first set of cutting guides extend in a direction along an axis or in a direction, or provides for a cutting guide pathway, that extends from the leading edge of the member towards or to a first outer or side edge of the member, and wherein the second set of cutting guides extend in a direction along an axis or in a direction, or provides for a cutting guide pathway, that extends from the leading edge of the member towards or to a second outer or side edge of the member.

In some embodiments, each cutting guide in the first set of cutting guides has a corresponding cutting guide in the second set of cutting guides, optionally, said each cutting guide and corresponding cutting guide being a mirror image of each other each other.

In some embodiments, each of the at least one cutting guides (or corresponding pairs of cutting guides in the first and second sets of cutting guides) corresponds with a particular roof pitch angle.

In some embodiments, the cutting guide is of a linear cutting guide pathway or is of a non-linear (e.g. curved) cutting guide pathway.

In some embodiments, said member comprises an underlapping region configured to be covered in use by an overlapping region of an adjacent member, optionally, said underlapping region is located at a trailing edge of said member.

In some embodiments, said member comprises an overlapping region configured to cover in use (or when installed) an underlapping region of an adjacent member, optionally, said overlapping region is located at a leading edge of said member.

In some embodiments, an upper surface of said member comprises an exposed surface.

In some embodiments, said member is longer in a direction from a leading edge to a trailing edge, said direction being a longitudinal axis, optionally, wherein said longitudinal axis is to be oriented when installed in a direction along a ridge or hip line.

In some embodiments, a length of the member is in the same direction as, or in a transverse direction to a ridge or hip line when installed In some embodiments, a width of the member is in the same direction as, or in a transverse direction to a ridge or hip line when installed.

In another aspect there is provided roofing, cladding or siding member comprising a plurality of formed regions corresponding to said roofing, cladding or siding member as defined in any of the above aspects.

In some embodiments, said module is provided with said edge feature, and each member of said module further comprises said cutting guide portions.

In some embodiments, a member portion is separable from the module to provide for a resized module.

In another aspect there is provided a roofing, cladding or siding member. The roofing, cladding or siding member may be provided with any of the features as described with respect to any of the above aspects.

In some embodiments, the member is provided a substantially flexible zone and a substantially rigid zone on each side of the flexible zone, the flexible zone adapted to allow the member to be bent by an installer by hand to conform the member to the ridge or hip of a roof with the flexible zone located along a ridge or hip line of the roof and with each rigid zone located on each side of the ridge or hip line.

In another aspect there is provided a module comprising a plurality of formed regions corresponding to said member as defined in any one of the any one of the above aspects.

In some embodiments, said module is provided with said edge feature, and each member of said module further comprises said cutting guide portions.

In some embodiments, a member portion is separable from the module to provide for a resized module In one aspect, the present invention broadly consists in a system of ridge or hip members as a plurality of ridge of hip members installed in an underlapping and overlapping configuration as described in the aspect above.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the invention will be described by way of example only and with reference to the drawings, in which:

FIGS. 13A to 12C show various views of another embodiment of a member.

DETAILED DESCRIPTION OF PREFERRED EMBODIMENTS

Figure 1:
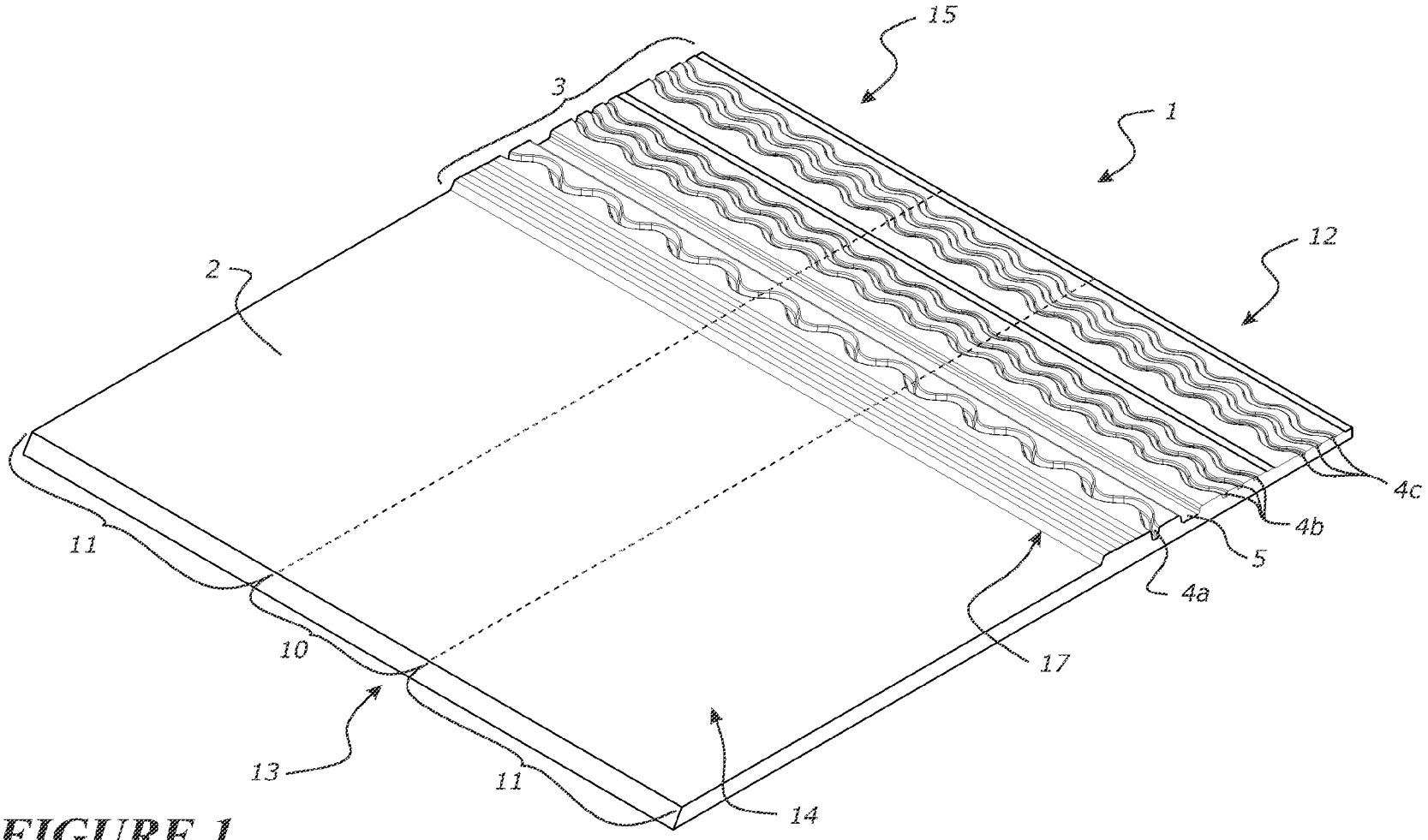
FIG. 1 is a top and side view of a ridge or hip member for the ridge or hip of a roof, the member shown in an uninstalled flat configuration.

Various embodiments are described with reference to the Figures. Throughout the Figures and specification, the same reference numerals may be used to designate the same or similar components, and redundant descriptions thereof may be omitted.

A ridge or hip member for a roof may comprise a substantially flexible zone 10 and a substantially rigid zone 11 on each or at least two sides of the flexible zone 10. The flexible zone 10 allows the member to be bent by an installer by hand to conform the member to the ridge or hip of a roof. During installation the flexible zone 10 is located along a ridge or hip line of the roof, with each rigid zone located on each side of the ridge or hip line. The installer bends the member over the ridge line to conform the member to the ridge of the roof. The member may be fastened to a building surface in the bent or installed configuration by fasteners applied through the member. When installed, the member forms a ridge or hip tile, to waterproof the ridge or hip of a roof.

The following are structural characteristics of the member 1 which may be combined with any of the other described features.

The member 1 may comprise an underlapping region 3. The underlapping region 3 may be configured to be covered in use by an overlapping region 2 of an adjacent member 1A. The underlapping region may be located at a trailing edge 12 of said member 1.

The member 1 may comprise an overlapping region 2 configured to cover in use (or when installed) an underlapping region 3 of an adjacent member 1A. The overlapping region 2 may be located at a leading edge 13 of said member 1.

Figure 9:
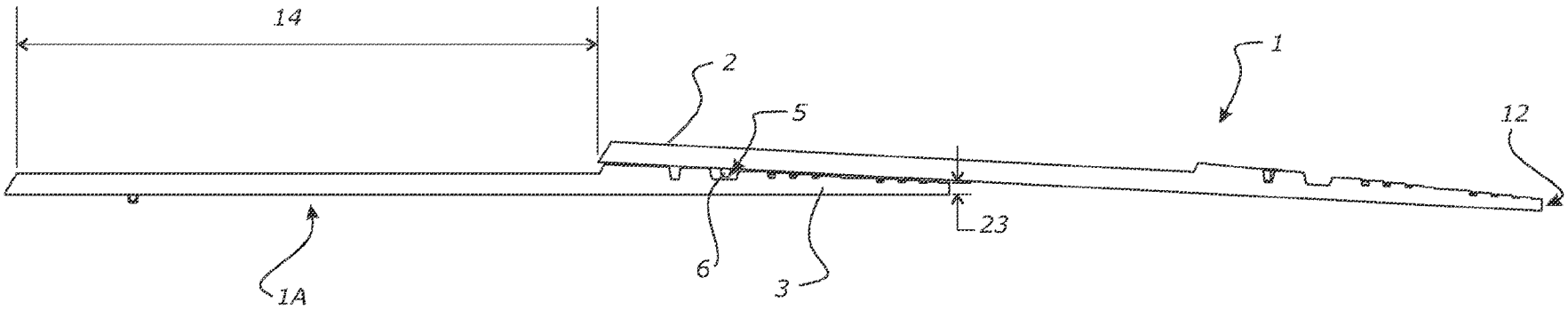
FIG. 9 is a side view showing two members of FIG. 1 overlapping.
Figure 10A:
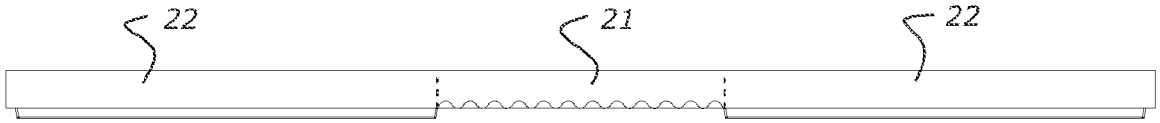
FIGS. 10A to 10D are schematic end views of the ridge or hip member of FIG. 1 in the uninstalled flat configuration, illustrating different materials or material layers in the member.
Figure 10B:
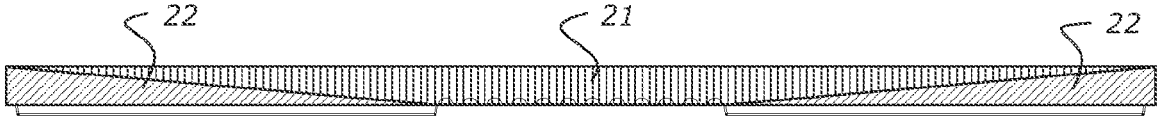
Figure 10C:
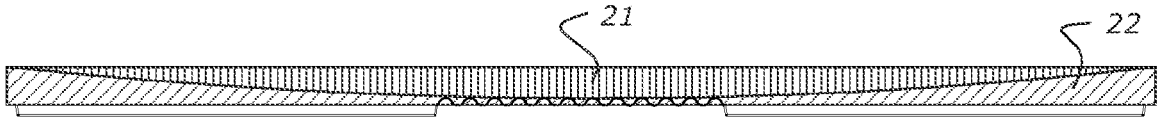
Figure 10D:
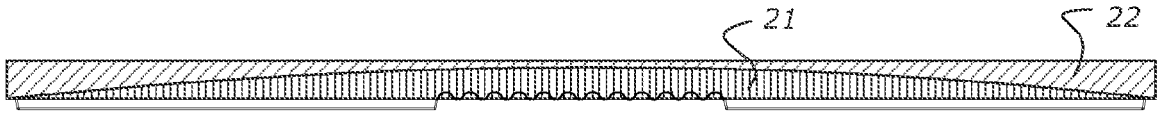

FIG. 9 shows an example of engagement between two members. The overlapping region 2 of a first member 1 is shown as covering an underlapping region 3 of an adjacent member 1A.

An upper surface of said member may comprise an exposed surface 14. The exposed surface 14 being uncovered when the member 1 is installed.

The member 1 may be longer in a direction from a leading edge 13 to a trailing edge 12 than a direction perpendicular to the direction from the leading edge to the trailing edge. In this case direction from a leading edge to a trailing edge is a longitudinal axis of the member 1. To be installed the longitudinal axis of the members, (or an axis in a direction along the flexible zone 10) may be oriented in a direction along a ridge or hip line. The flexible zone 10 may then accommodate a ridge or hip line, as the flexible zone 10 bends, deforms or flexes it creates a surface to cover said ridge or hip line. In some embodiments the member may be shorter in the direction from the leading edge 13 to the trailing edge 12 than the direction perpendicular to the direction from the leading edge to the trailing edge.

The flexible zone 10 may be located between a plurality of rigid zones 11. In some embodiments the flexible zone 10 may be located between a pair of rigid zones, or may be flanked by a pair of rigid zones. The flexible zone may be located between 3 (for example in a Y or T configuration), or 4 (for example in a cross or X configuration) or 5 or 6 rigid zones, for example to cover over a junction of three or four or more ridge lines of a roof.

The substantially flexible zone 10 may be relatively more flexible than the substantially rigid zone(s) 11 on each side of the flexible zone. The substantially flexible zone 10 may be relatively more flexible than the substantially rigid zone(s) 11 on each side of the flexible zone 10 in a transverse direction of the ridge or hip member 1.

The substantially rigid zone 11 each side of the flexible zone 10 may be relatively more rigid than the substantially flexible zone 10. The substantially rigid zone 11 each side of the flexible zone 10 may be relatively more rigid than the substantially flexible zone 10 in a transverse direction of the ridge or hip member 1.

The flexible zone may extend from a leading edge of said member to a trailing edge. Additionally or alternatively, the flexible zone may be oriented to extend in a direction along a longitudinal, or transverse axis of said member.

The member 1 may be between about 100 mm and about 500 mm in width (ie a direction perpendicular to the hip or ridge line or in a direction substantially parallel to the leading edge or trailing edge), optionally the member 1 may be about 300 mm in width.

The member 1 may be between about 100 mm and about 500 mm in length (ie a direction along the hip or ridge line or in a direction substantially perpendicular to the leading edge or trailing edge), optionally the member 1 may be about 315 mm in length.

The terms longitudinal and transverse are used with reference to the embodiment as shown in FIG. 1. In the context of this embodiment the term longitudinal is used to describe a lengthwise direction of the member, in the direction of a ridge or hip of the roof. It will be appreciated that the term longitudinal may be replaced by the phrase 'in the direction of a ridge or hip of the roof' in cases when the member may be longer in a direction transverse to the direction of a ridge or hip of the roof.

The member 1 may comprise engagement features to connect or align adjacent members. The member 1 comprises a first engagement feature 6 and a second engagement feature 5. The first engagement feature 6 and second engagement feature 4 may allow for weather tight sealing between a member 1 and an adjacent member 1A.

The first engagement feature 6 and/or the second engagement feature 4 may engage with an engagement feature of an adjacent member. The engagement of the first engagement feature 6 and/or the second engagement feature 4 with an engagement feature of an adjacent member locates, or co-locates or sets the relative position of the member and the adjacent member. The engagement of the first engagement feature 6 and/or the second engagement feature 4 with an engagement feature of an adjacent member may additionally or alternatively provide for a connection between said ridge or hip member and said adjacent member. The first engagement feature 4 of a member 1 may be configured to engage with a second engagement feature 6 of an adjacent member. The second engagement feature 6 of a member 1 may be configured to engage with a first engagement feature 5 of an adjacent member.

In some embodiments the first engagement feature 6 may be located on an upper surface of an underlapping region 3 and the second engagement feature 6 is located on a lower surface of an overlapping region 2. In some other embodiments the first engagement feature 6 may be located on a lower surface of an overlapping region 2 and the second engagement feature 6 is located on a 2 an upper surface of an underlapping region 3.

In the embodiment as shown in FIGS. 1-9 the first engagement feature 6 is a projection and the second engagement feature 5 is a recess, groove or alignment channel. However it will be appreciated that the first and second engagement features may comprise other features to facilitate other methods of connection between members (for example a tongue and groove). In some embodiments, the first engagement feature my comprise a projection extending downwardly from the overlapping region 2 and the second engagement feature may be a shoulder 17 facing towards the leading edge 13 of the member.

In some embodiments the first engagement feature 6 is a projection, and the second engagement feature 5 being a recess, or groove. Such first engagement feature 6 and second engagement feature 5 are shown in FIGS. 1-9. The recess 5 is adapted to receive the projection 6 of an adjacent and/or overlapping ridge or hip member to substantially locate or co-locate or set the relative position the adjacent members when installed. An engagement between a recess 5 of a member 1 and a projection 6 of an adjacent member 1A is shown in FIG. 9. In the embodiment as shown in FIG. 9 the recess 5 is located on an upper surface of the underlapping region, and the projection 6 is located on the underside of the underlapping region. Alternatively the first engagement feature 6 may be a recess, and the second engagement feature 5 may be a projection. The first engagement feature 6 may be a projection and may be dimensioned, and/or sized and shaped, so as to be prevented from engagement with and/or a seating within at least one fluid channel 4*a*, 4*b*, 4*c* (described below). The fluid channel may also be dimensioned, and/or sized and shaped, so as to be prevented from engagement with and/or a seating within said projection. The inability for the projection to engage with a fluid channel aids in ease of installation of a member to an adjacent member. In a first step a first member is installed on a roofing surface. To install a further member the member to be installed is pushed upward over the already installed member. The projection on the underside of the underlapping region will pass over at least one fluid channel without engaging (or will be unable to engage) said at least one fluid channel before reaching said recess and become engaged with said recess 5. This for easy installation without having to ensure that a member is accurately placed on top of an adjacent member. The fluid channel may also be located closer or more toward a leading edge of the member or a leading edge of the member than the recess.

As shown in FIG. 1 alignment channel or groove or second engagement feature 5 may extend laterally across the member 1. Additionally the alignment channel may extend across a first rigid zone, a flexible zone and a second rigid zone. The alignment channel may also be located substantially parallel to a leading edge 13 or a trialing edge 12 of the member 1.

The projection (being a first engagement feature 6) may comprise a plurality of projections. The plurality of projections may be spaced apart in a lateral direction to the roof ridge or hip region, the recess or recesses of an adjacent member may be configured to receive said plurality of projections.

Figure 3:
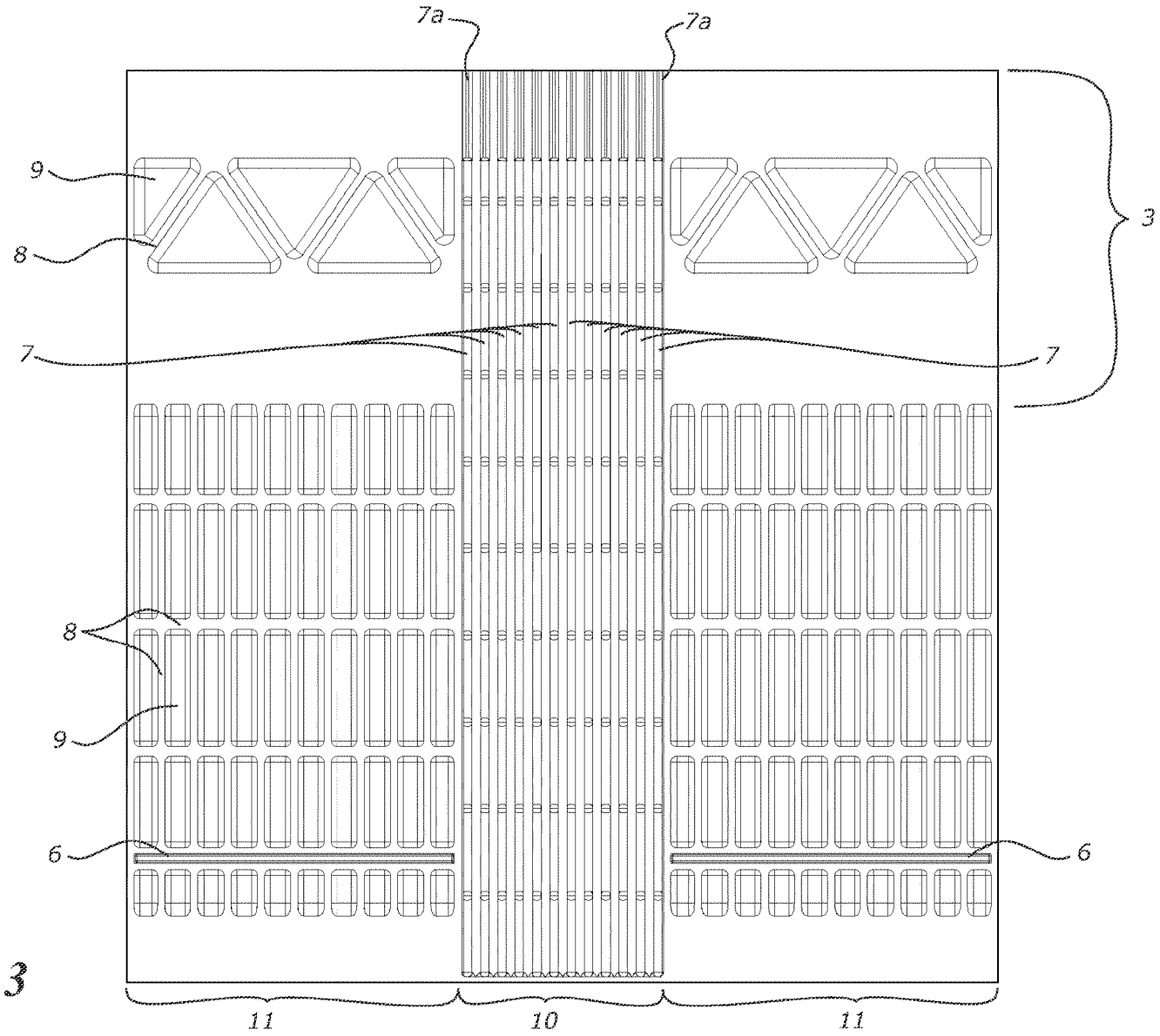
FIG. 3 is a bottom view of the ridge or hip member of FIG. 1 in the uninstalled flat configuration.

The projection (being a first engagement feature 6) may also have a width less than the width of the recess (being a second engagement feature 5). This allows for some relative movement of the projection within the recess when engaged, the relative movement of the projection within the recess allows for the relative location of engaged members to also be adjusted while the engagement features still remain engaged. This allows for an installer to fine-tune the position of engaged members without having to disengage connection. The relative movement of the projection within the recess may also allow for rotational alignment of a member and an adjacent member. This may be particularly useful where a ridge or hip of a roof is not perfectly straight. As shown in FIG. 3 the projection(s) may be located exclusively in the rigid zones, and absent from the flexible zone.

One or both of an upper surface of an underlapping region 3 and a lower surface of an overlapping region 2 comprise a glue or adhesive strip or region. The glue or adhesive may be a pressure sensitive adhesives (however other types of adhesive are contemplated).

The member may comprise at least one fluid channel (4*a*, 4*b*, 4*c*) in an upper surface of the underlapping region 3. The at least one fluid channel (4*a*, 4*b*, 4*c*) may extending across the width of the member, and/or extends laterally with respect to the ridge or hip line of the roof and/or parallel to a leading edge 13 or a trailing edge 12 or the member. The at least one fluid channel (4*a*, 4*b*, 4*c*) may be configured to direct any fluid received between the overlapping and underlapping regions of adjacent members down the roof surface away from the ridge or hip line of the roof. The at least one fluid channel may be configured to prevent or reduce water penetrating between adjacent members from the leading edge of a member to the trailing edge of an adjacent underlapping member. As shown in at least FIG. 2 the member 1 may comprise a plurality of fluid channels, arranged in at least one fluid channel group. There may be at least two fluid channel groups, each comprising at least two fluid channels. The fluid channel groups may be spaced apart from each other to allow for a multiple redundancy water protection system. Additionally or alternatively, a first fluid channel 4*a* located nearest to the leading edge and/or the overlapping region may have a greater channel depth and/or width than the other fluid channels 4*b*, 4*c*.

The at least one fluid channel (4*a*, 4*b*, 4*c*) may have a depth of between about 1 mm and about 10 mm, or between about 2 mm and about 5 mm or about 3 mm; and a width of between about 1 mm and about 10 mm, or between about 2 mm and about 5 mm or about 4 mm.

The first fluid channel 4*a* located nearest to the leading edge and/or the overlapping region may have a depth of about 3 mm and/or a width of about 4 mm, while the other fluid channels have a depth of about 2 mm and/or a width of about 3 mm.

Figure 2:
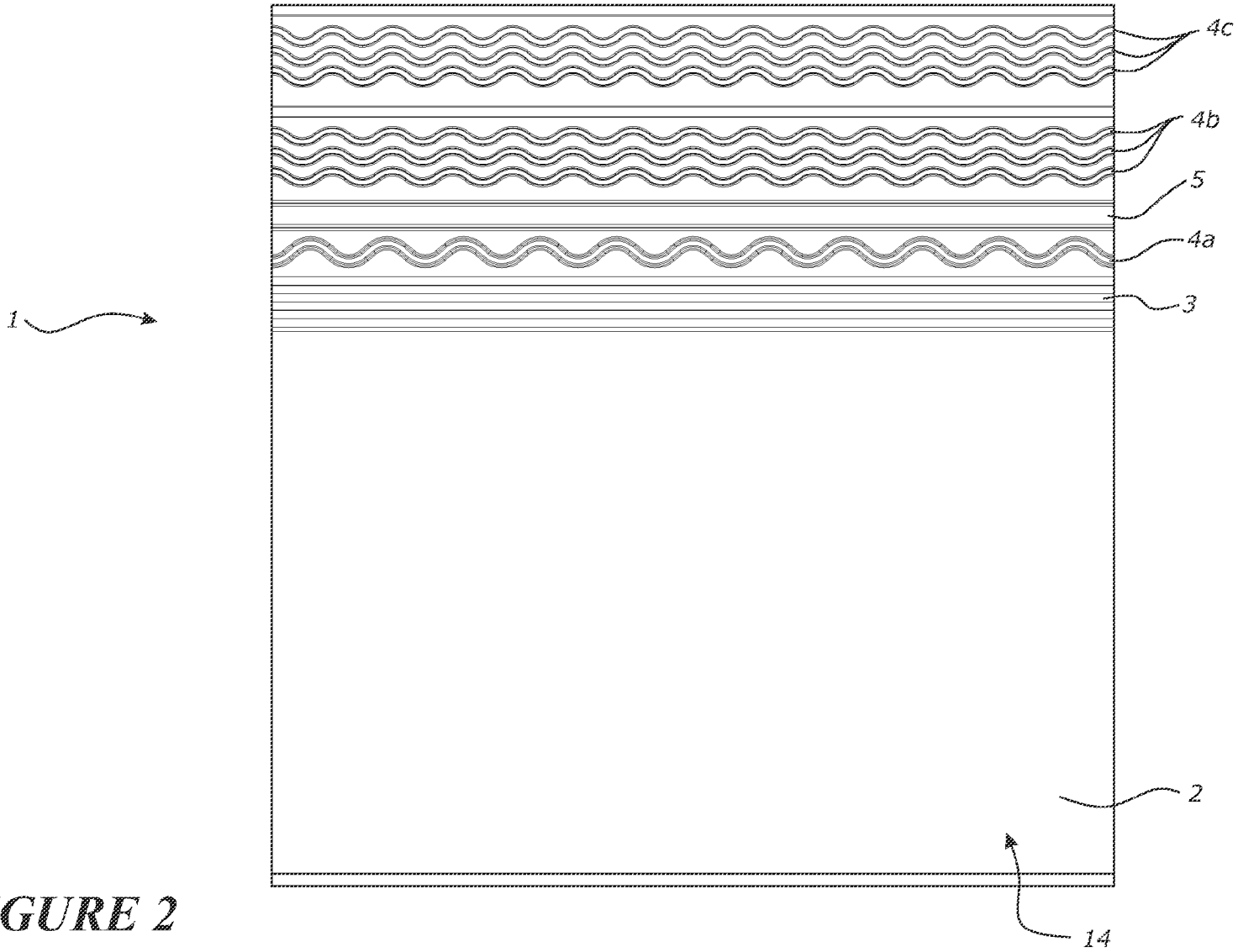
FIG. 2 is a top view of the ridge or hip member of FIG. 1 in the uninstalled flat configuration.

As shown in FIG. 2 the at least one fluid channel may be wavy path, and/or substantially sinusoidal path, and/or is of a shape or configuration which is not engageable by said projection. The wavy path or sinusoidal path may have a pitch of between about 2 mm and about 15 mm, or between about 4 mm and about 10 mm, or about 5 mm, and an amplitude of between about 10 mm and about 40 mm, or between about 20 mm and about 30 mm or about 25 mm. The wavy path prevents the fluid channel from engagement with the projection 6 of an overlapping member during installation of the overlapping member. The water channels may be otherwise shaped or configured to prevent engagement with the engagement projection 6 of an overlapping member. For example, where the projection 6 extends perpendicular to the longitudinal direction of the member, the water channels may be arranged at an angle other than perpendicular to the longitudinal direction, or may be non-linear, e.g. a square wave form or shape, saw tooth wave form shape or other non-linear shape. Alternatively the projection may comprise a non-linear shape in a direction across the member.

FIG. 1 shows flexible zone 10. The flexible zone is configured to be bent or deformed to accommodate a ridge or hip line of a roof to which it is to be attached. Further, when bent or deformed the flexible zone may allow the rigid zone to be aligned with the roof on either side of the ridge or hip. The flexible zone may have an relaxed or non-deformed condition where it is substantially planar. An installer may bend or deform the flexible zone to a bent or deformed state for installation on the ridge or hip line of a roof to suit a particular roof pitch. The member may be suitable for conforming to the hip or ridge for a range of roof pitches.

In some embodiments the flexible zone 10 may comprise a ramped portion 41 on the underside of the member 1.

The flexible zone 10 may span at least 5%, or at least 10%, or at least 15%, or at least 20% of the total length or width of the member in a direction perpendicular to the direction of the hip or ridge line of a roof). For example, a member comprising a width of 300 mm in a direction perpendicular to the hip or ridge line, the width of the flexible zone may be about 15 mm to 60 mm or more.

The flexible zone 10 presents a minimum bend radius of at least 20 mm, or at least 25 mm, or at least 30 mm, or at least 35 mm, or at least 40 mm, or at least 45 mm, or at least 50 mm. The minimum bend radius of the flexible zone may correspond with a maximum bendable state of said flexible zone such that when the flexible zone is bent, it will bend to a maximum bendable state. The maximum bendable state may be provided by or defined by engagement of one or more features of the flexible zone. The features may be one or more of: a plurality of ribs extending in a longitudinal direction of the member, or a plurality of alternating peaks and valleys.

The flexible zone 10 may be more flexible than the rigid zones by comprising one or more of:

- different geometry and/or material in the flexible zone and the rigid zones
- a concertina-type section in the flexible zone
- an area of variable thickness in the flexible zone relative to the rigid zones
- a variation in material properties and/or material in said flexible zone relative to the rigid zones
- a reduced thickness in said flexible zone relative to the rigid zones
- a reinforced polymer in said rigid zone and/or an unreinforced polymer in said flexible zone
- a polymer of a first stiffness in said flexible zone, and a polymer of a second stiffness in said rigid zone, wherein said second stiffness is greater than said first stiffness.

Some of these configurations are discussed in more detail below.

The flexible zone 10 may have a first stiffness, or longitudinal stiffness or, a stiffness in the direction of the ridge or hip line which is similar or substantially the same as a first stiffness or longitudinal stiffness or, a stiffness in the direction of the ridge or hip line of a said rigid zone 11. The first stiffness is greater than a stiffness of the flexible zone in a direction transverse to the hip or ridge line. As a result when bending the member along the direction of the ridge or hip line (e.g. bending of the member over the ridge or hip) the flexible zone 10 and rigid zone 11 resist bending transverse to the ridge or hip line.

In some embodiments, the flexible zone 10 has a stiffness in a direction transverse to the longitudinal direction (or a direction perpendicular or transverse to the direction of the ridge or hip line) which is substantially less that the stiffness of the rigid zone in a direction transverse (or a direction perpendicular or transverse to the direction of the ridge or hip line) to the longitudinal direction. As a result the flexible zone 10 may deform or bend across said ridge or hip line to accommodate the ridge or hip, while the rigid zone or zones 11 remain substantially undeformed or unbent, or planar.

In some embodiments the member is anisotropic, with a greater stiffness in the direction of the ridge or hip line and a lesser stiffness in a direction transverse to the ridge or hip line.

The member 1 may have a first elastic modulus or first stiffness in a width direction (or a direction perpendicular or transverse to the direction of the ridge or hip line) and a second elastic modulus or second stiffness in a length direction (or in the direction of the ridge or hip line) where the first elastic modulus or first stiffness is less than the second elastic modulus or second stiffness. This allows the member to bend to accommodate the ridge or hip line while retaining its shape along the length of the ridge or hip line. In some embodiments, the second elastic modulus is between 1.5 times and 20 times that of the first elastic modulus, or at least twice the first elastic modulus.

Additionally of alternatively, the rigid zone 11 may stay substantially planar when installed. This ensures that an overlapping or underlapping adjacent member can engage and seal with another member. In some embodiments when the member is installed, deflection of said member is of or confined to the flexible zone 10.

The flexible zone 10 may comprise a plurality of spaced apart grooves 7 in a lower surface of the member 1. The grooves 7 may be arranged side-by-side across the width of the flexible zone 10 and extending in a direction (e.g. a length or longitudinal direction) of the member to be arranged along the ridge or hip line of the roof. In some embodiments the grooves extend to an edge, or close to an edge, of the member in the underlapping region. Optionally, the depth of the grooves at the edge of the member in the underlapping region may be less than the depth of the grooves along a remainder of the grooves. The grooves may have a depth of about 3 mm and/or a width of 5 mm, optionally 3 mm. Sides (e.g. longitudinal sides) of adjacent grooves may engage or make contact in a maximum bendable state, to provide a limit to bending or define the maximum bendable state.

The member 1 may have a first thickness in the rigid zones 11 and a second thickness in the flexible zone 11, the first thickness may be greater than the second thickness. In some embodiments the thickness of the member in the flexible zone 10 is less than the thickness of the member in the rigid zones 11. In some embodiments the thickness of the flexible zone 10 is less than the thickness of the rigid zones 11 for substantially the full width of the flexible zone 10 (i.e. in a direction transverse to the ridge or hip line).

Figure 8:
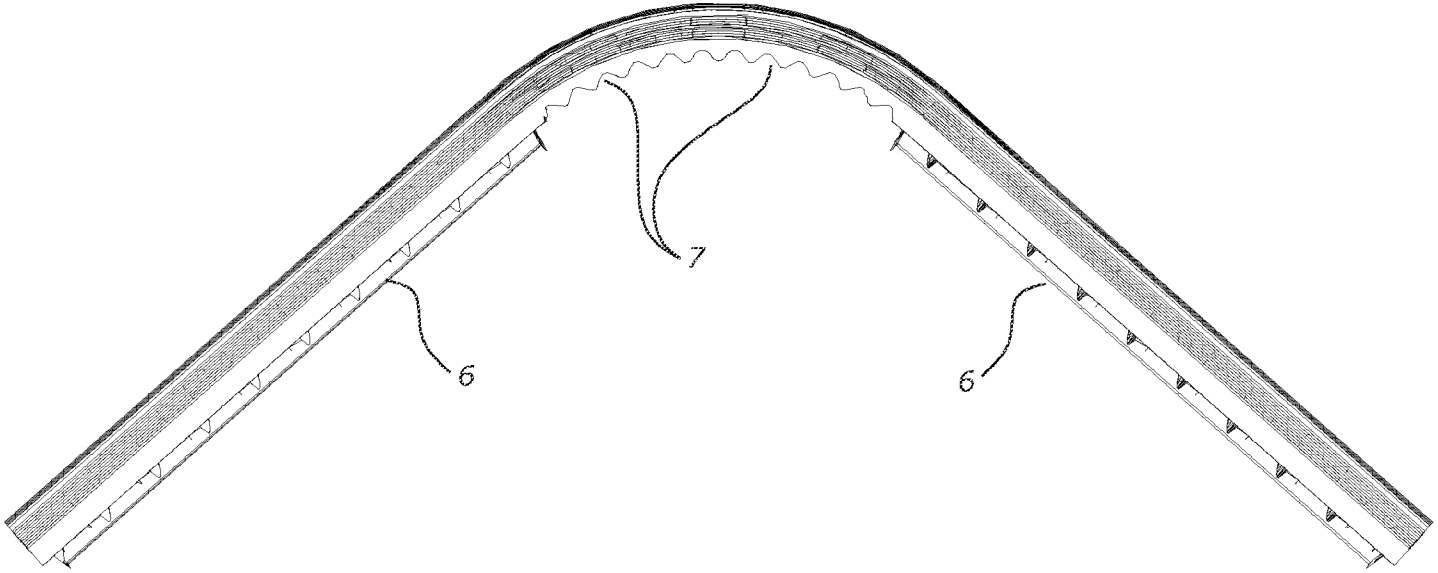
FIG. 8 is an end view of the ridge or hip member of FIG. 1 in the installed bent configuration, showing an underlapping end of the member.

As shown in FIG. 8 the flexible zone 10 may be configured to bend to provide for an arc shaped profile across the flexible zone 10, in a direction transverse to the hip or ridge line. The arc may extend in a transverse direction to extend substantially over a ridge or hip of a building surface to be clad. Optionally, said flexible zone may be configured to bend substantially evenly and/or substantially uniformly across its width, i.e. in a direction transverse to the hip or ridge line. In some embodiments the flexible zone is configured to substantially bend evenly and/or substantially uniformly across its width to provide for a substantially constant radius of curvature across said flexible zone when bent.

As described earlier, the flexible zone preferably provides a minimum bend radius relating to a maximum bendable state. The maximum bendable state is with respect to normal operating loads, and is achievable by bending the member by an installer by hand and without assistance of mechanical tools or applying mechanical advantage. The length of the arc shaped profile preferably extends over the full transverse dimension of the flexible zone. The flexible zone preferably flexes over an arc length with a minimum length of at least 20 mm, or 30 mm, or 40 mm, or 50 mm, or 60 mm, or 70 mm. The arc length spans over the hip or ridge line. As the flexible zone bends with a minimum bend radius the flexible zone does not provide or act as a hinge between the rigid zones. A hinge, such as a living hinge, has a higher stress level due to the thin section of the hinge and a relatively tight bend radius. In contrast to a hinge, the flexible zone deforms more gradually over a relatively long arc length and with a minimum bend radius that is significantly greater than a bend radius of a hinge. Bending stress in the member is distributed across the width of the flexible zone, rather than being concentrated at a bend point. Thus the flexible zone achieves a continuous or uniform loading across the flexible zone, rather than a concentrated point load at a distinct location of the member.

In some embodiments, said rigid zone 11 is stiffer along an axis (optionally a transverse axis and/or from a leading edge of the member to a trailing edge of the member) than an axis (optionally a transverse axis and/or from a leading edge of the member to a trailing edge of the member) of said flexible zone 10. In some embodiments, the flexible zone is stiffer along a first axis (optionally a longitudinal axis, or an axis extending parallel to one or more of: a leading edge of the member to a trailing edge of the member) than a second axis (optionally a transverse axis and/or from a leading edge of the member to a trailing edge of the member) to allow the member to be bent along said second axis while resisting bending in the first axis.

The flexibility of the flexible zone 10 may be provided by a flexible region. The flexible region may be located on an underside of said ridge or hip member. The flexible region may not extend through to an upper surface of the ridge or hip member so as to not be visible from said upper surface. In some embodiments an exposed surface 14 of the ridge or hip member may be substantially flat. In some embodiments the said exposed surface 14 comprises surface decoration or patterning or texturing to emulate natural or man-made roofing materials such as timber shakes or shingles, asphalt shingles. In the embodiments with a flexible region which is located on the underside of the member, any features which provide for the flexibility are not visible from the upper surface. Because the flexible region (for example grooves 7) is not visible from the upper surface a smooth or decorated surface finish can be provided to the exposed side of the member 1.

In some embodiments the flexible zone may comprise at least a first layer and at least a second layer. The first layer may, at least in, part define the underside of the flexible zone of the ridge or hip member. The second layer may, at least in part, define an upper surface of the flexible zone of the ridge or hip member to be exposed in use. The first layer may comprise said flexible region, and the second layer may be a substantially flat or planar surface, or of a substantially uniform thickness. As the flexibility of the flexible zone is provided for in the first layer, and the surface finish provided in the second layer a better surface finish can be provided as the finish of the first layer is not important as the first layer is not visible once the member is installed.

In some embodiments the second layer is configured to stretch to accommodate a bending or deflection of said flexible region of said first layer. The exposed surface may comprise decoration or patterning or texturing to emulate natural or man-made roofing materials such as timber shakes or shingles, asphalt shingles. Similarly, the first layer may be configured to compress in a direction along a length or width on bending or deflecting of said member.

In some embodiments the flexible zone comprises a first material and the rigid zones comprise a second material, and the first material is more flexible than the second material. Optionally the second material comprises different physical properties to the first material for example different flexibility, different hardness, or different deformation characteristics Additionally or alternatively the member comprises at least two material layers. The member may comprise a first layer comprising a first material, and a second layer comprising a second material. In some embodiments the first material is more flexible than the second material. In some embodiments in the flexible zone a thickness of the first layer is greater than a thickness of the second layer. additionally or alternatively, in each rigid zone a thickness of the second layer is greater than a thickness of the first layer.

The member may comprise a first material and a second material. The first material is more flexible than the second material, and the flexible zone includes more of the first material than the second material. Additionally or alternatively, the rigid zones include more of the second material than the first material. In some embodiments the flexible zone may be without the second material, and in some embodiments the rigid zones may be without the first material.

An amount of the first material in each rigid zone may reduce across the width of the rigid zone from the flexible zone towards an edge of the member. Additionally or alternatively, an amount of the first material increases in the flexible zone from each said rigid zone towards a centre of the flexible zone. The first material and the second material may each comprise the same polymer or polymers, or the polymer or polymers of the first material are different to the polymer or polymers of the second material. In some embodiments, the first or second material is or comprises one or more elastomers. In some embodiments the first material may comprise at least one polymer and a first loading level of reinforcing and/or filler. The second material may comprise at least one polymer and a second loading level of reinforcing and/or filler. The first loading level may be less than the second loading level so that the first material is more flexible than the second material.

As shown in FIG. 3, in some embodiments the member may comprise a plurality of ribs 8. In some embodiments the ribs 8 are located on the lower surface of the rigid zones 11. The ribs 8 may define cavities 9 between the ribs. The ribs 8 may be provided to give strength to the rigid zones 11. The ribs 8 may be oriented in a longitudinal direction, or a transverse direction, or both longitudinal direction and a transverse direction. The ribs 8 may extend in one or more of a first axis (optionally a transverse axis and/or from a leading edge of the member to a trailing edge of the member) and a second axis (optionally a longitudinal axis, or an axis extending parallel to one or more of: a leading edge of the member to a trailing edge of the member).

Figure 11A:
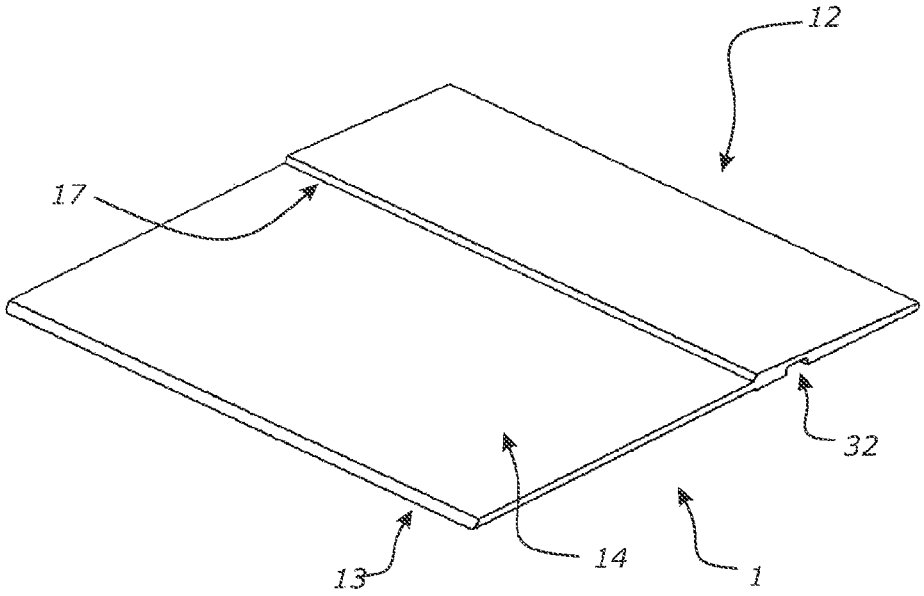
FIG. 11A is a perspective view of a further embodiment of the ridge or hip member in the uninstalled flat configuration.
Figure 11B:
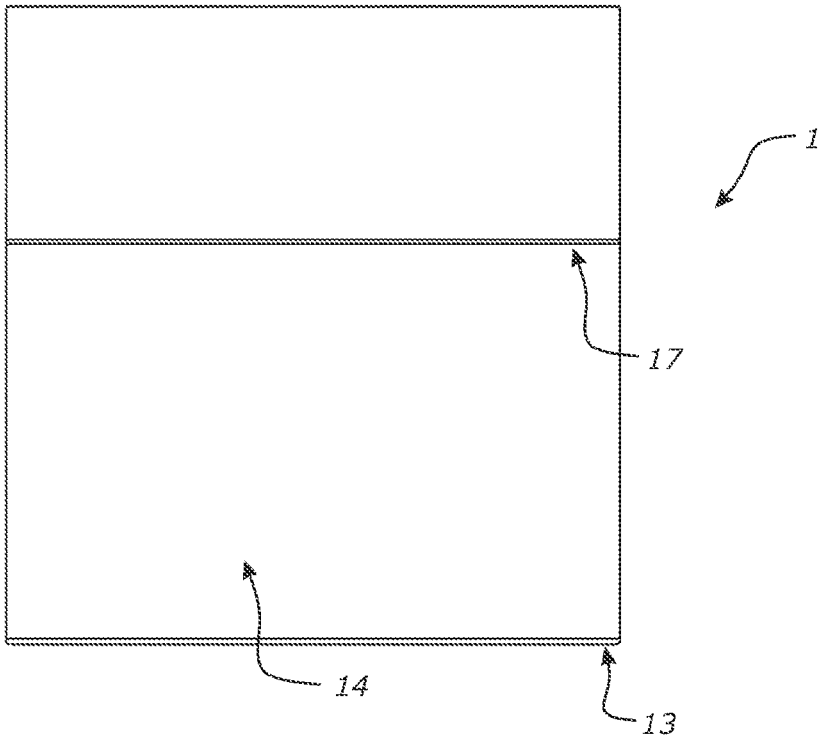
FIG. 11B is a top view of ridge or hip member or FIG. 11A in the uninstalled flat configuration.
Figure 11C:
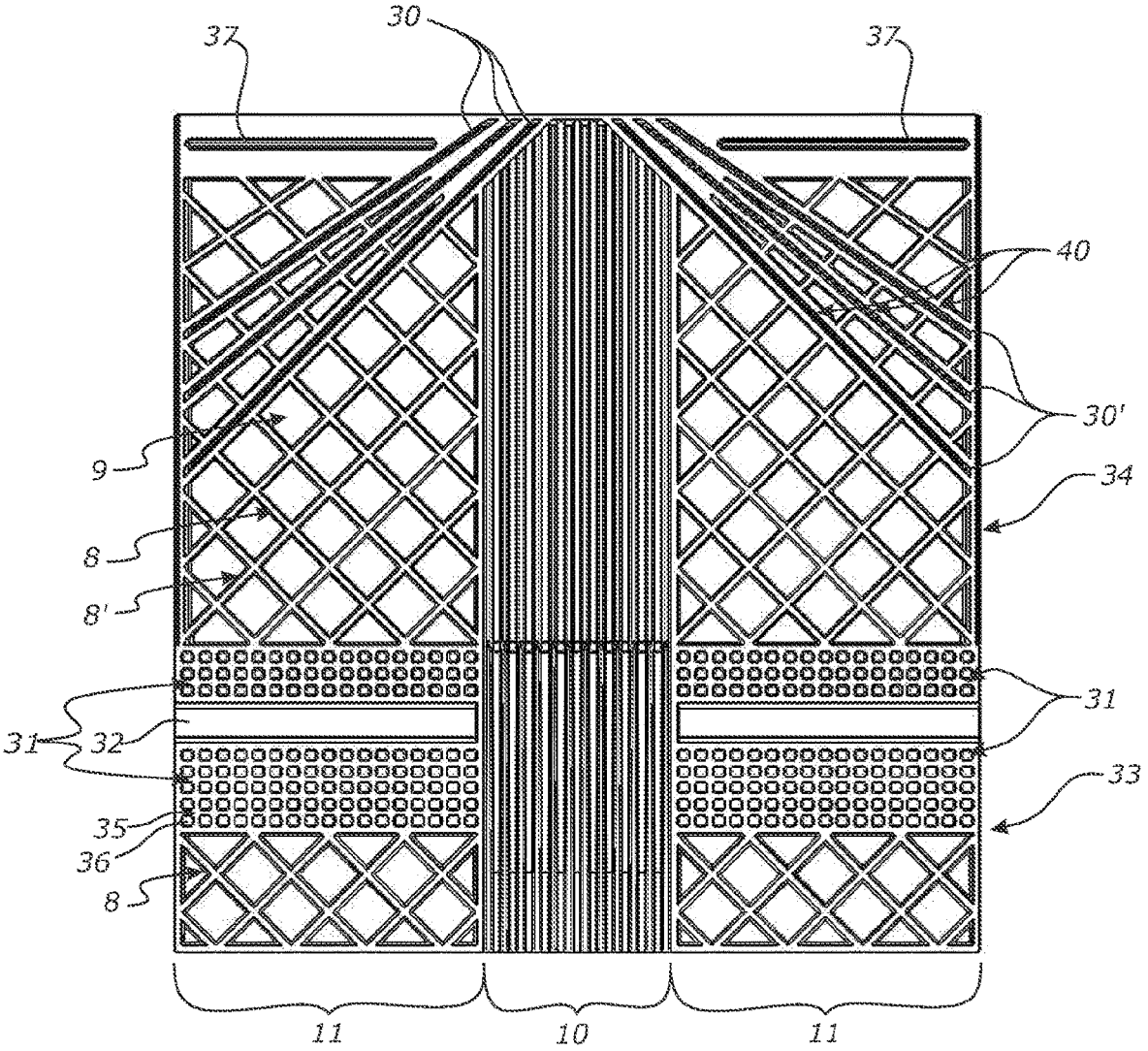
FIGS. 11C and 11D are views of the under surface of embodiments of the ridge or hip member or FIGS. 11A and 11B in the uninstalled flat configuration.
Figure 11D:
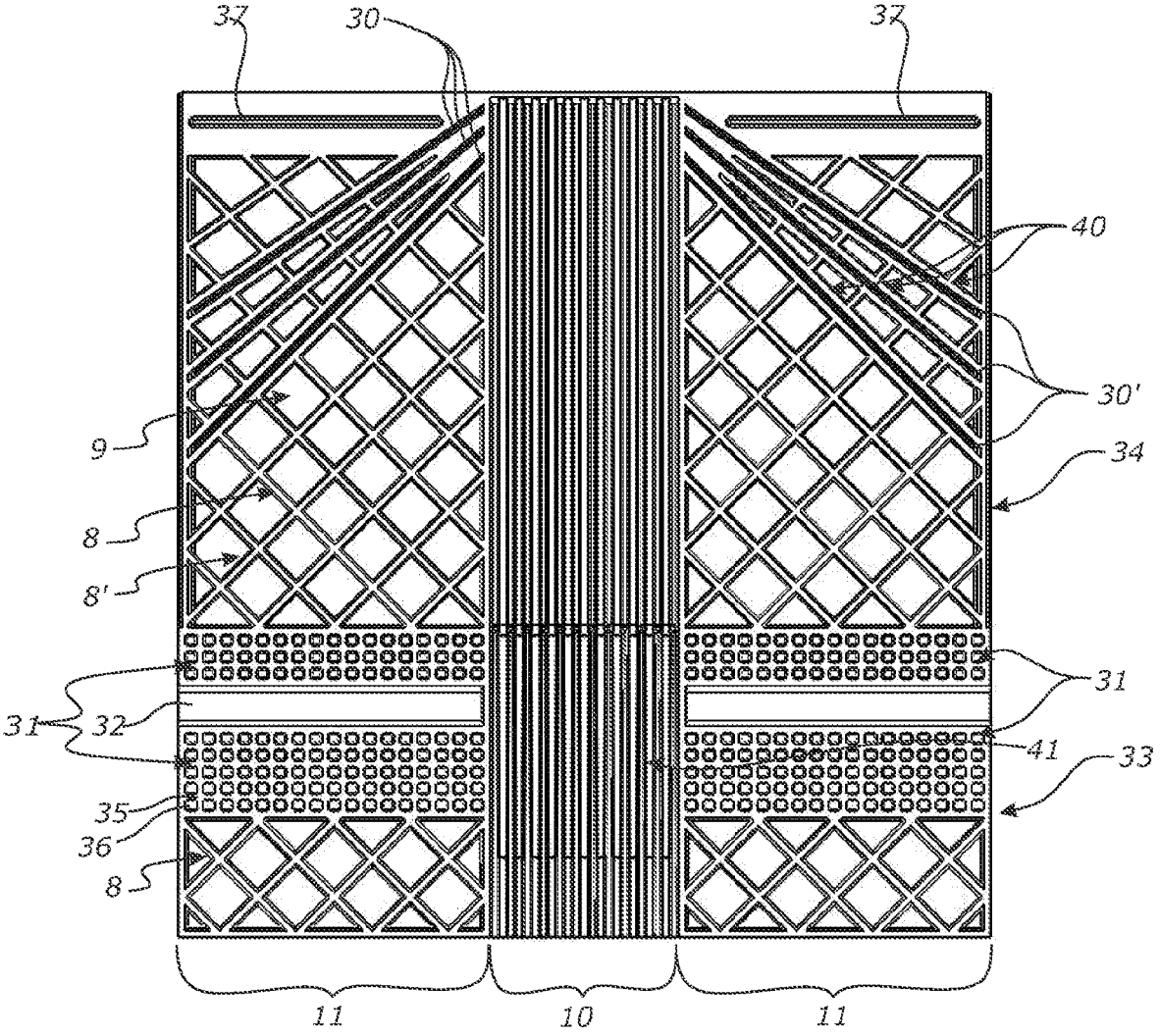
Figure 11E:
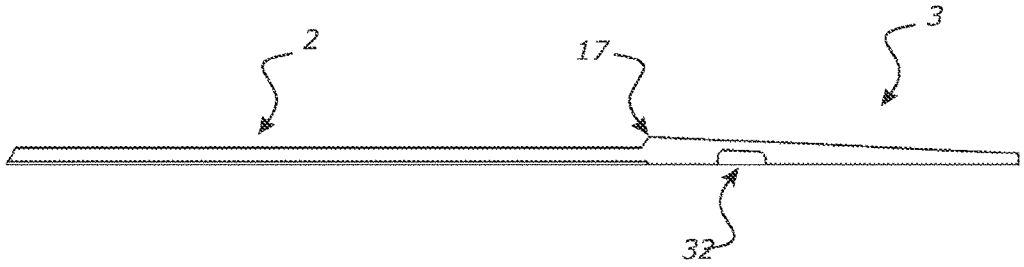
FIGS. 11E and 11F are a side view and end view of ridge or hip member of FIGS. 11A-11D in the uninstalled flat configuration.
Figure 11F:
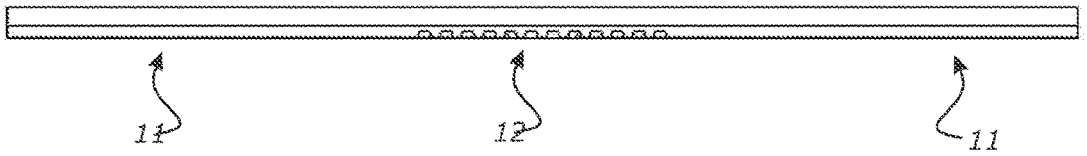
Figure 11G:
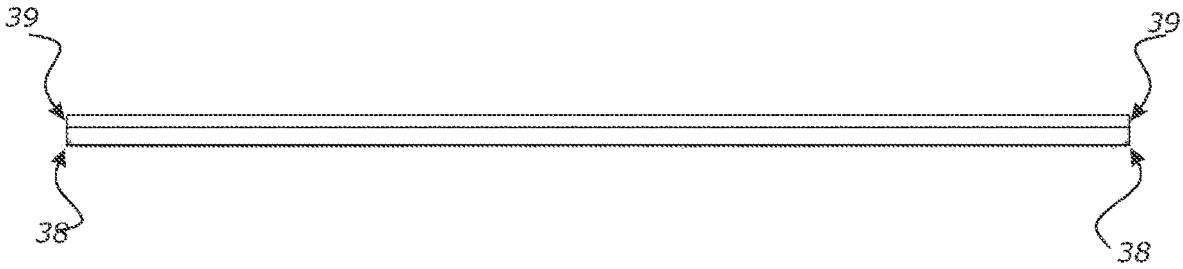
FIGS. 11H and 11I are perspective views of the under surface of embodiments of the ridge or hip member or FIGS. 11A and 11B in the uninstalled flat configuration.
Figure 11H:
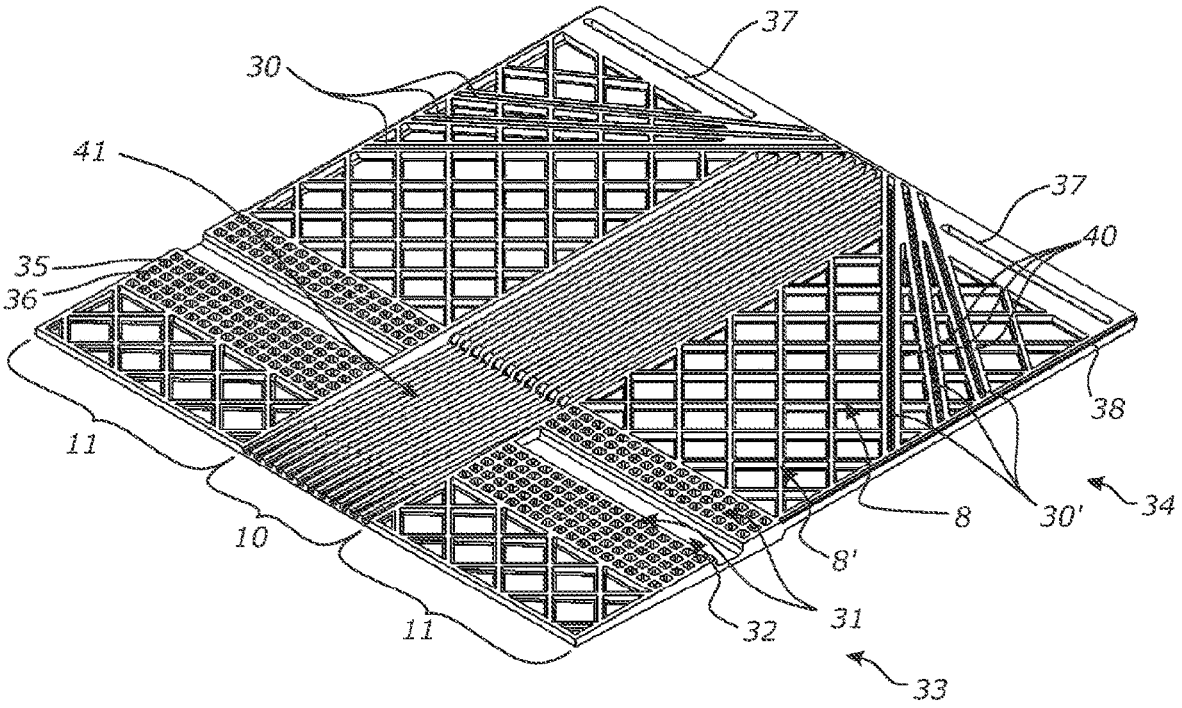
Figure 11I:
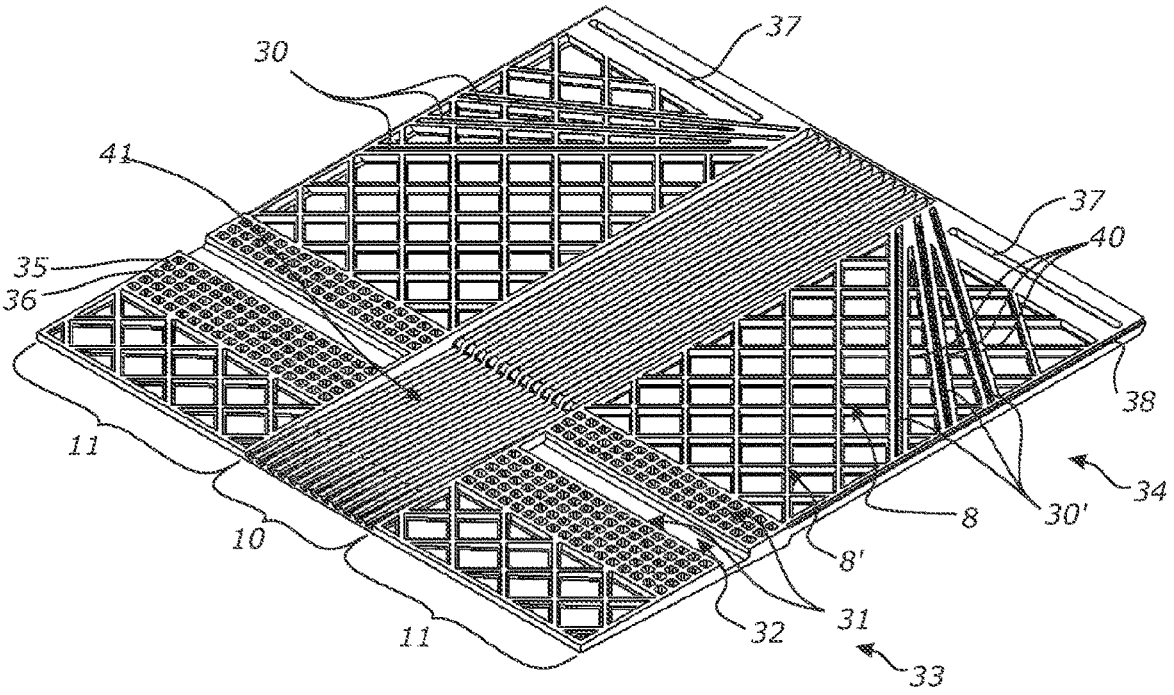

As shown in FIGS. 11C-11D in some embodiments the ribs 8 may be oriented in a direction at an angle to a both a longitudinal direction and a transverse direction. The ribs 8 may extend in one or more of a first axis (optionally disposed at angle to a transverse axis and/or disposed at angle to a leading edge of the member to a trailing edge of the member) and a second axis (optionally a disposed at angle to longitudinal axis, or an axis extending or disposed at angle to one or more of: a leading edge of the member to a trailing edge of the member).

In some embodiments at least one of the ribs may be oriented along an axis substantially perpendicular to one or more cutting guides 30 (for example rib 8). Additionally or alternatively, at least one of the ribs 8 may be oriented along an axis substantially perpendicular to one or more cutting guides 30 (for example rib 8'.

In some embodiments (for example as shown in FIG. 11C) the ribs 8 may be located between adjacent cutting guides 30.

The ribs may comprise at least a first set of ribs, and at least a second set of ribs. In some embodiments the first set of ribs may for example be ribs 8 and extend in a first direction or along any of the axis as described above. The second set of ribs may for example be ribs 8' and extend in a second direction (for example being a different direction to the first direction. or along any of the axis as described above.

In some embodiments the first set of ribs 8 are arranged substantially perpendicular to the second set of ribs 8'.

The ribs 8 may form a pattern or be patterned on underside of the rigid zones 11. In some embodiments the ribs 8 may form a crisscross type pattern with the ribs 8 and ribs 8' being the first and second sets of ribs and/or in the directions as described above.

The ribs 8 being disposed in a more than one direction along the underside of the rigid zone 11 (for example a crisscross type pattern) provides for stiffness in the rigid zone 11 in more than one axis. The ribs 8 provide for stiffness or strength in a direction along the length of the ribs 8 or 8'. As shown in the pattern of ribs 8 and 8' of FIGS. 11C-11D, where an angled X-type crisscross type pattern is used. However it is envisaged a +-type crisscross type pattern could also be used.

The ribs 8 may provide a stiffness or relative rigidity to the ridge or hip member in a direction extending from a central axis or longitudinal axis of the ridge or hip member towards one or more leading corner(s) of the ridge or hip member. In this way the ribs may ensure that the tile maintains its substantially flat profile across the entire surface of the tile, and/or the exposed surface 14. The ribs 8 also ensure the leading corners are held in contact with the building surface or an adjacent tile or member when installed.

In some embodiments the crisscross type pattern may form cavities 9 between said ribs 8.

The ribs 8 may be arranged as a pattern to cover a substantial portion of the underside of the ridge or hip member. In some embodiments the ribs are arranged in a pattern to cover a substantial portion or an entire underside of the exposed surface or region 14.

In some embodiments the ribs are arranged in a pattern to cover a substantial portion or an entire underside of the underlapping region 13.

The ribs 8 may provide rigidity to the rigid zones 11 both in the direction of the ridge or hip of the roof and/or in a direction transverse or perpendicular to the ridge or hip. The benefits of the stiffness in these directions is described above. Providing ribs 8 on the underside of the rigid zones 11 is one way of achieving this, and it will be appreciated that other methods may also provide strength in these directions.

In some embodiments the width and/or length of the member in the underlapping region is less than the width and/or length of the member in the overlapping region such that edges of the member in the underlapping region are obscured from view by an adjacent overlapping member.

The member may comprise a step 17 in an upper surface of the member 1 at a boundary of an underlapping region 3. The step 17 may transition into an elevated upper surface of the underlapping region as a raised region 15. The raised region 15 may be elevated above an upper surface of the member adjacent to said boundary of said underlapping region configured to be exposed in use. Alternatively or additionally the raised region 15 may be elevated relative to an exposed region of the member 1. The step 17 may present a shoulder to bear against a downward projection of an overlapping member to relative alignment of the members.

The step 17 may comprise a ramped surface or be angled away from the upper surface of the member 1 adjacent to said boundary of said underlapping region 3 configured to be exposed in use towards the upper surface of the underlapping region 3.

The upper surface of the underlapping region 3 (optionally in said raised region 15) may slope relative to a lower surface of the underlapping region 2 away from the overlapping region 3.

The upper surface of the underlapping region 3 (optionally in said raised region 15) comprises a ramped region 16. The ramped region 16 may have a positive gradient (relative to a lower surface of the underlapping region 3) in a direction away from a trailing edge 12 of the member towards said leading edge 13.

Figure 4:
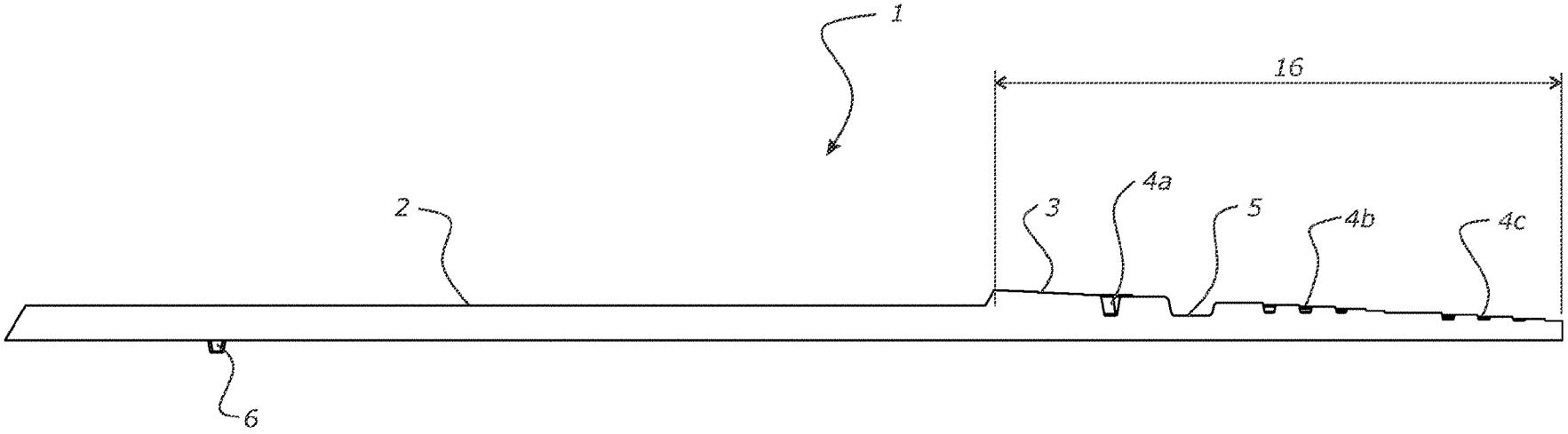
FIG. 4 is a side view of the ridge or hip member of FIG. 1 in the uninstalled flat configuration.
Figure 5:
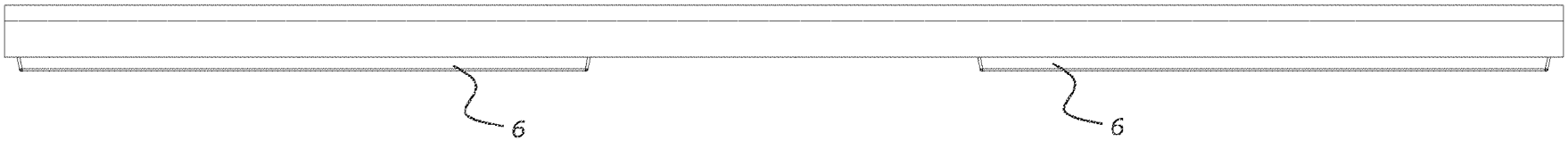
FIG. 5 is an end view of the ridge or hip member of FIG. 1 in the uninstalled flat configuration, showing an overlapping end of the member.
Figure 6:
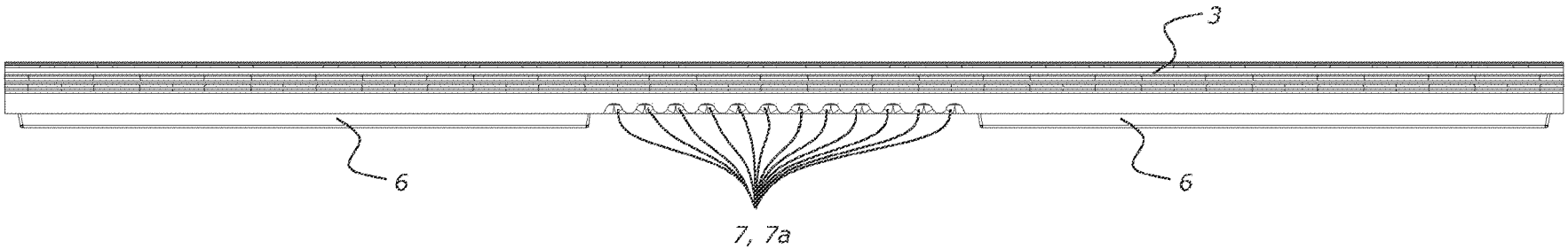
FIG. 6 is an end view of the ridge or hip member of FIG. 1 in the uninstalled flat configuration, showing an underlapping end of the member.
Figure 7:
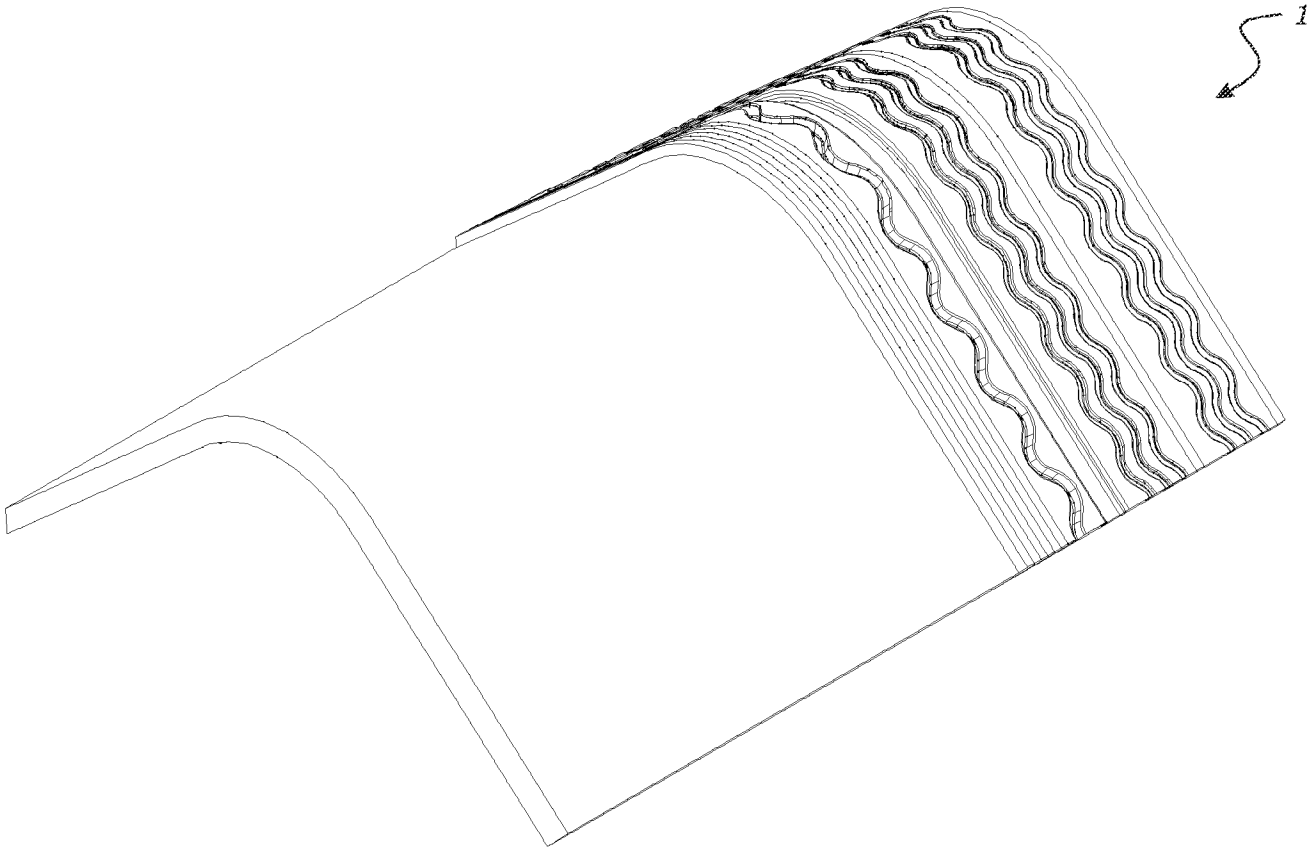
FIG. 7 is a top and side view of the ridge or hip member of FIG. 1 shown in an installed bent configuration.

In the embodiment as shown in FIG. 4 the ramped region is the entire length of the upper surface of the underlapping region 3. In some embodiments the ramped region may extend for only part of the underlapping region 2, or the majority of the length of the upper surface of the underlapping region 3. The underlapping region 3 said member may be tapered from a relatively thinner end at or closer to a trailing edge of the member to a relatively thicker end closer to a leading edge of the member. The tapering of the underlapping region towards the trailing edge 12 provides a reduced gap 23 between an overlapping member and a building surface to which the member is installed, at the trailing edge of the underlapping member, as shown in FIG. 9. The gap 23 is reduced compared to if the underlapping region was not tapered from the leading edge of the underlapping region. The reduced gap allows the overlapping members to achieve a flatter roof surface, and plaster or mortar or other filler compound may not be required to fill the gap between the overlapping member and the building surface. A reduced gap also achieves a reduced amount of deflection should a load be applied to an overlapping member, potentially avoiding damage to the member.

The member may be installed on a roofing surface by at least one fastener. The ridge or hip member may comprises at least one fastening zone 31. The fasteners may be provided to or pass therethrough the fastening zone 31 so as secure or provide for a securement of the member to a building surface and/or an adjacent member.

The at least one fastening zone 31 may be located within the or each rigid zone 11.

For example as shown in FIG. 11C where a fastening zone 31 located in each of the two rigid zones.

The at least one fastening zone 31 may be located in the underlapping region 2 of the ridge or hip member 1. This may allow for the fastener to be covered by the overlapping region of an adjacent member.

In some embodiments the member may comprise at least one flexible or hinged portion 32. The flexible or hinged portion 34 may be located in each rigid zone 11.

The at least one flexible or hinged portion 32 may allow for flexibility or hinging about a substantially transverse axis of the member.

In some embodiments the flexible or hinged portion 32 may allow for a relative flexing or hinging of a first portion 33 of each rigid zone 11 relative to a second portion 34 of each rigid zone 11. The first portion 33 of each rigid zone 11 may be located nearer or more toward a leading edge 13 of the ridge or hip member 1 than the second portion 34 of each rigid zone 11.

The flexing or hinging portion 32 may isolate and/or attenuate and/or prevent the transmission of forces from the first portion 33 of each rigid zone 11 relative to a second portion 34 of each rigid zone 11.

The fastening zone 31 may be located on one or both sides of a flexible or hinged portion located 32 in each rigid zone 11.

The fastening zone 31 may be located on one or both sides of a recess located in each rigid zone and the recess may act as said flexible or hinged portion 32.

The at least one fastening zone 31 may comprise a pair of fastening zones 31, each fastening zone 31 located in each rigid zone 11.

The or each fastening zone 31 may comprises two subsections disposed on either side of a recess and/or said flexible or hinged portion 32.

In some embodiments the fastening zone comprises at least one rib 35. The rib 35 may be located on the underside of the member in the fastening zone 31. The fastening zone 31 may be relatively stiffer than the remainder of the relatively rigid zone 11 (other than the relatively flexible or hinging portion). In some embodiments the fastening zone 31 may be thicker than the remainder of the relatively rigid zone 11

The at least one rib 35 of the fastening zone 31 may comprise at least a first set of ribs and a second set of ribs. As shown in FIG. 11C the ribs 35 comprise a first set and a second set or ribs. The ribs 35 may be oriented as described with respect to the ribs 8 or 8' as described above. In the embodiment of FIGS. 11C and 11D the ribs 35 of the fastening zone 31 are arranged differently than the ribs 8 or 8'.

The ribs 35 may be arranged both in a longitudinal direction or axis and a transverse direction or axis of the member 1. In some embodiments the ribs 35 may be orientated in the similar direction to the ribs (for example 8 or 8') of the remainder of the rigid zone 11, or a different direction.

In some embodiments, the cavity size of the ribs 35 formed between adjacent ribs 35 may be substantially smaller than in the other ribs 8 or 8'. This may allow for additional stiffness in the fastening zone 31 as described above.

The at least one rib 35 may be arranged in a criss-cross or intersecting type arranged pattern.

The first set of ribs may be arranged substantially perpendicular to the second set of ribs (for example as shown in FIGS. 11C and 11D).

At least one cavity 36 may be formed between the ribs 35. In some embodiments the least one cavity 36 may be formed between first set of ribs and the second set of ribs. The cavity 36 may be configured to be receivable of at least one fastener.

The cross sectional area of the cavity 36 may be configured to be smaller or the same size as the cross-sectional area of at least one fastener.

The distance between the first set of ribs and the second set of ribs, and/or at least one dimension of the cavity 36 may be smaller or the same size as the largest dimension of at least one fastener.

The ribs 36 may be configured to engage with a head and/or portion of the fastener when installed, to distribute a fastening force over the fastening zone.

To aid in receipt of the fastener the underlapping region 3 may comprise an area of increased thickness (such as an increased cross-sectional thickness) compared to a remainder of the member. The area of increased thickness through which fasteners may be provided may help to secure the member to a building surface.

In some embodiments, an underlapping region 3 of the member 1 may comprise an indicia corresponding with the location for receipt of a fastener to secure the member to a building surface. The underlapping region 3 may also comprise a reinforced area for receipt of a fastener, optionally the indicia is located in said reinforced area. The reinforced area may be provided by a reinforcing layer, or the addition of reinforcing to the reinforced area.

The ridge or hip member 1 may comprise at least one recess 37 along a leading edge 13 in the or each rigid zone 11. In some embodiments the recess 37 is parallel to the leading edge 13.

The ridge or hip member 1 may be configured to receive at least one glue portion and/or line and/or bead on one or both sides of the at least one recess 37. The least one glue portion and/or line and/or bead may be configured to engage with an adjacent member when installed. The at least one glue portion and/or line and/or bead may create a waterproof seal.

In some embodiments the member may comprise at least one edge feature 38, the edge feature 38 may be located at, or near, and/or along one or more of: a side or outer edge 39 and/or the leading edge 13, and/or the trailing edge 12 and/or about a portion of the perimeter of the member. In some embodiments the edge feature 38 may be aligned substantially parallel to said edge. The edge feature 38 may be one or more of a raised wall, or recess.

In some embodiments the edge feature 38 may extend in a direction away from an upper surface of the member and/or from the upper surface towards a building surface to which the member is attached, and/or an adjacent member.

In some embodiments the exposed section or portion comprises the edge feature 38. In some embodiments the edge feature 38 is restricted to being provided on or about the exposed section or portion.

Alternatively, in some embodiments the underlapping surface is not provided with an edge feature 38.

In some embodiments the edge feature 38 provides for a barrier to the underside of the ridge or hip member 1. In some embodiments the edge feature 38 provides for a visual barrier, such that when installed the underside of the member is not visible from the side or outer edge 39 of the member.

The edge feature 38 may be configured to engage with the exposed surface of an adjacent tile or member when installed.

The edge feature 38 may be configured to provide a continuous face of a side or outer edge 39 of the member.

In some embodiments the ridge or hip member may comprise at least one cutting guide 30/30'. The cutting guide 30/30' may be located on an underside of the exposed region or portion 14 of the ridge or hip member 1.

The at least one cutting guide 30/30' may comprises one or more of a thinned region, and/or a slot, and/or a region of reduced member material thickness.

In some embodiments the ridge or hip member 1 comprises an edge feature 38 (as described above) and/or a raised wall 40 located along at least one side and/or around said at least one cutting guide 30/30'. The edge feature 38 or raised wall 40 may provide for a barrier to the underside of the ridge or hip member. In some embodiments the edge feature 38 or raised wall 40 is provided along an inner surface of the cutting guide 30/30'.

The edge feature 38 or raised wall 40 of the cutting guide 30/30' may provide for a visual barrier, such that when installed the underside of the member is not visible.

The edge feature 38 or raised wall 40 of the cutting guide 30/30' may be configured to engage with the exposed surface of an adjacent member when installed.

The edge feature 38 or raised wall 40 of the cutting guide 30/30' may be configured to provide a continuous face of an edge of the ridge or hip member 1 when the ridge or hip member 1 is cut along said cutting guide 30/30'.

The at least one cutting guide 30/30' may be configured to allow removal of at least one or more, or optionally a pair of leading corner(s), or other portions, of the ridge or hip member 1.

As shown in FIG. 11D the at least one cutting guide 30/30' may be located within each rigid zone 11. The member may comprise a cutting guide 30/30' or set of cutting guides in each rigid zone 11.

In some embodiments, for example as shown in FIGS. 11C and 11D, the at least one cutting guide comprises a first cutting guide or a first set of cutting guides 30 and a second cutting guide or a second set of cutting guides 30'.

The first cutting guide or first set of cutting guides 30 may extend in a direction along an axis or in a direction, or provides for a cutting guide pathway, that extends from the leading edge 13 of the ridge or hip member towards or to a first outer or side edge 39 of the member.

The second cutting guide or second set of cutting guides 30' extend in a direction along an axis or in a direction, or provides for a cutting guide pathway, that extends from the leading edge 13 of the ridge or hip member towards or to a second outer or side edge 39 of the member.

Each cutting guide in the first set of cutting guides 30 may be a corresponding cutting guide in the second set of cutting guides 30. Each cutting guide and corresponding cutting guide being a mirror image of each other each other.

Each of the at least one cutting guides (or corresponding pairs of cutting guides in the first and second sets of cutting guides) may correspond with a particular roof pitch angle.

The second set of cutting guides 30 may be a mirror image of the first set of cutting guides about a longitudinal or central axis.

The cutting guide may be a linear cutting guide pathway or is of a non-linear (e.g. curved) cutting guide pathway.

The cutting guide or set of cutting guides 30 in each rigid zone may be a mirror image of the at least one cutting guide located in the other of each rigid zone 11 along a central or longitudinal axis.

The at least one cutting guide 30 may extend from a leading edge 13 of the ridge or hip member 1 across part of the flexible zone 10, and at least part of the rigid zone 11 towards or to an outer edge 39 of the ridge or hip member.

The at least one cutting guide 40 may be provided along an axis or in a direction from the leading edge 13 of the ridge or hip member 1 towards or to an outer edge 39 of the ridge or hip member 1.

The at least one cutting guide 30 may comprise one, or two or three or more cutting guides 30.

In some embodiments, each of the one or more cutting guides 30 (as part of a set of cutting guides) is disposed at a different angle from each of the other one or more cutting guides 30 (of the set of cutting guides).

In some embodiments, each of the one or more cutting guides is disposed at a different angle from one or more of:

a longitudinal axis of the ridge or hip member
a transverse axis of the ridge or hip member
a leading edge the ridge or hip member
a trailing edge the ridge or hip member.

In some embodiments the member is formed from or comprises at least one polymer and comprises reinforcing and/or filler in the polymer in the rigid zones and no reinforcing or filler in the polymer in the flexible zone.

In some embodiments, the member at least one polymer and reinforcing and/or filler in the polymer. The member has a first loading level of reinforcing or filler in the flexible zone and a second loading level of reinforcing or filler in the rigid zones, and wherein the first loading level is less than the second loading level. Optionally, the second loading level is at least twice the first loading level. In some embodiments the second loading level of the filler or reinforcing or both is at least 40%, or 50%, or 60%, or 70%, or 80%, or 90% w/w.

Additionally or alternatively, the member is formed from or comprises at least one polymer and reinforcing and/or filler in the polymer, and the reinforcing and/or filler is aligned in a length direction of the member to be aligned with the direction of the ridge or hip line of the roof.

The filler may be one or more of the following: talc, calcium carbonate, mica, silica, kaolin, calcium sulphate, magnesium hydroxide, stabilizers, dolomite.

The reinforcement may be one or more of the following: glass fibres, glass beads, glass flakes, flax, cellulose, wood fibres, wood flour, cotton, sawdust, inorganic fibres, polymer fibres, polymer scrim, polymer knit, polymer weave, aramids, ceramics, carbon fibres The member is formed from one or more polymers. The polymer(s) may be or contain one or more elastomers. Optionally, the one or more elastomers are or contain a thermoplastic elastomer.

Potential polymers may be one or more of: polystyrene (GPPS), polyethylene terephthalate (PET), polyester methacrylate (PEM), high impact polystyrene (HIPS), acrylonitrile butadiene styrene (ABS), polyvinyl chloride (PVC), polyurethanes (PU), polyethylene (PE) including homopolymer, copolymer, block copolymer and terpolymer forms, polylactic acid (PLA), nylon (PA), acrylics (PMMA), high density polyethylene (HDPE), low density polyethylene (LDPE), linear low density polyethylene (LLDPE), medium density polyethylene (MDPE), cross linked polyethylene (PEX), thermoplastic elastomer (TPE), thermoplastic polyolefin (TPO), thermoplastic rubber (TPR), polypropylene (PP), including homopolymer and copolymer forms, polybutylene terephthalate (PBT), styrene-acrylonitrile resin (SAN), ethylene tetrafluoroethylene (ETFE), vinyl, methacrylate copolymers, foamed polymer, polycarbonates, and combinations thereof.

FIGS. 12A-14B show a member 100 which does not have a flexible zone 10.

The member 100 may have any of the features as described above with reference to the member 1.

The member may be of a substantially constant stiffness in a transverse axis. In some embodiments the member 100 may be substantially rigid (as described with reference to the rigid zone 11 above.

The member 100 may have a fastening zone 31. Fasteners may be provided to or pass therethrough the fastening zone 31 so as secure or provide for a securement of the member to a building surface and/or an adjacent member. The fastening zone 31 may have features of the fastening zone 31 as described above.

The member 100 may have at least one rib 8, 8', 8" located on the underside of the member 100. The rib may provide stiffness to the member 100 in one or more directions. The at least one rib 8, 8', 8" may be as described above. In the embodiments as shown in FIGS. 12A, 12B, 13A, 13B and 14A, 14B there are three ribs provided. Ribs 8 and 8" are provided angled with respect to the leading edge 13 and/or the trailing edge 12 (as per the embodiments of for example FIGS. 11C and 11D). However, the member 100 has a further rib 8" which is provided substantially parallel to the leading edge 13 and/or the trailing edge 12.

The at least one rib 8, 8', 8" may form one or more or a plurality of cavities 9.

The member 100 may also comprise at least one recess 37 (as described above).

The member 100 may also comprises one or more edge features 38 (as described above).

Figure 14A:
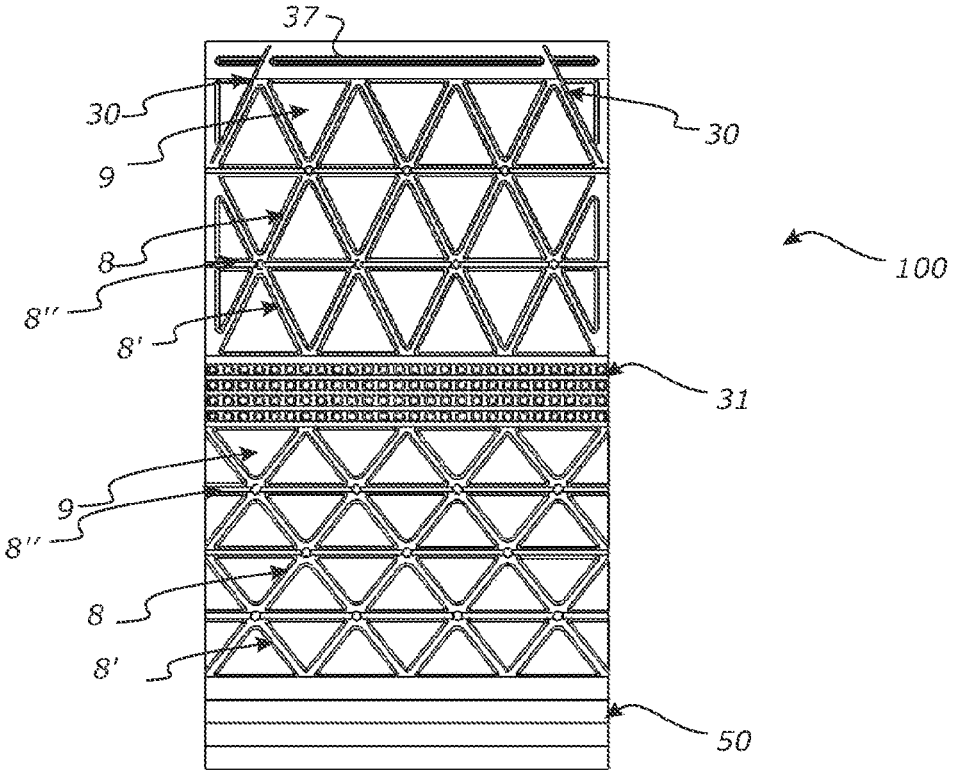
FIGS. 14A to 14B show various views of another embodiment of a member.
Figure 14B:
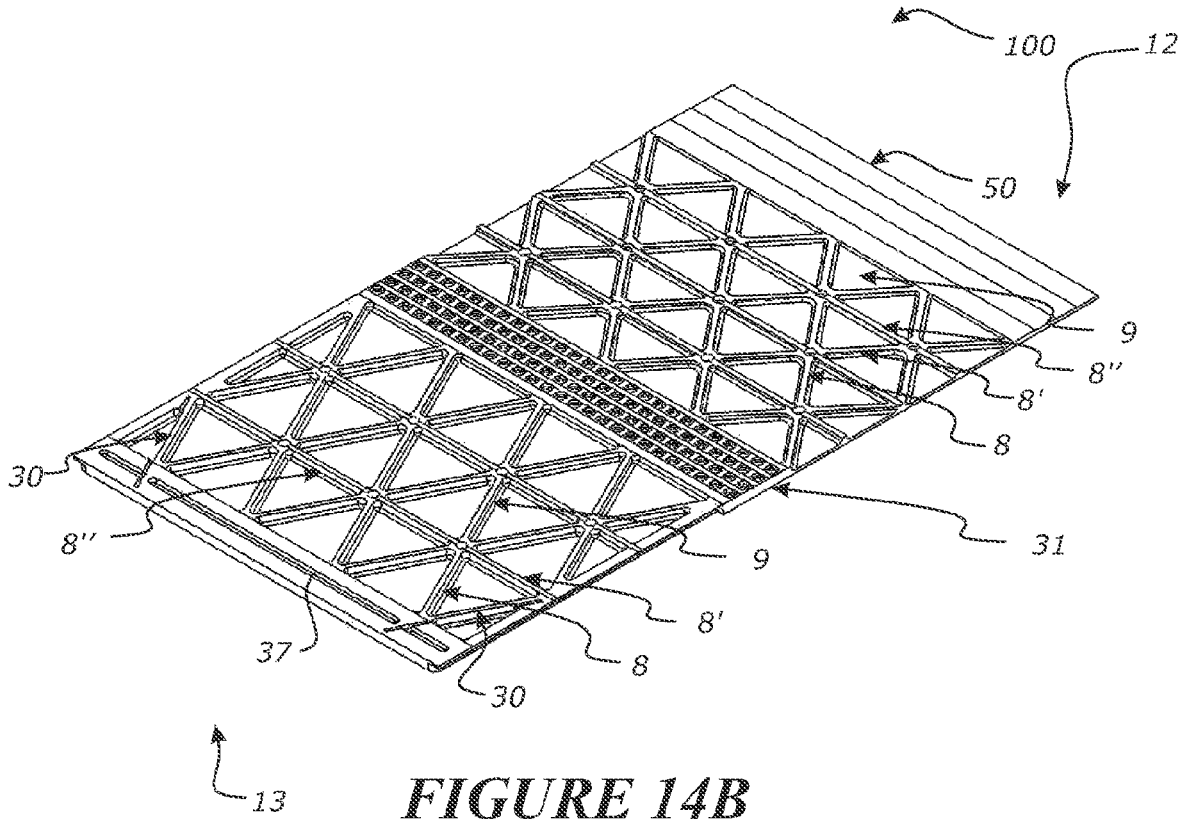
Figure 15A:
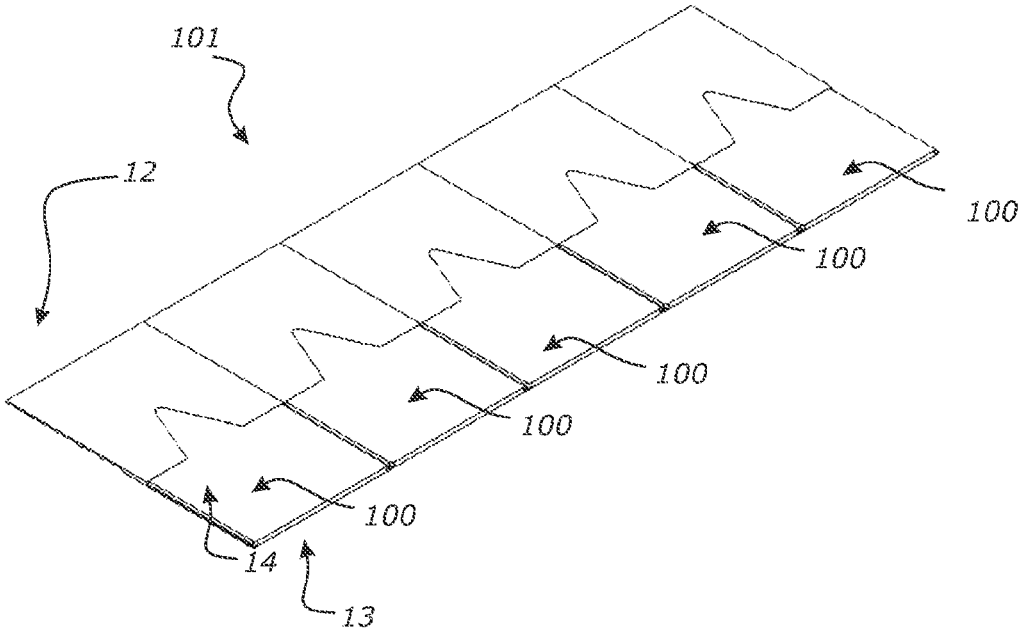
FIGS. 15A to 15B show a series of members as a module.
Figure 15B:
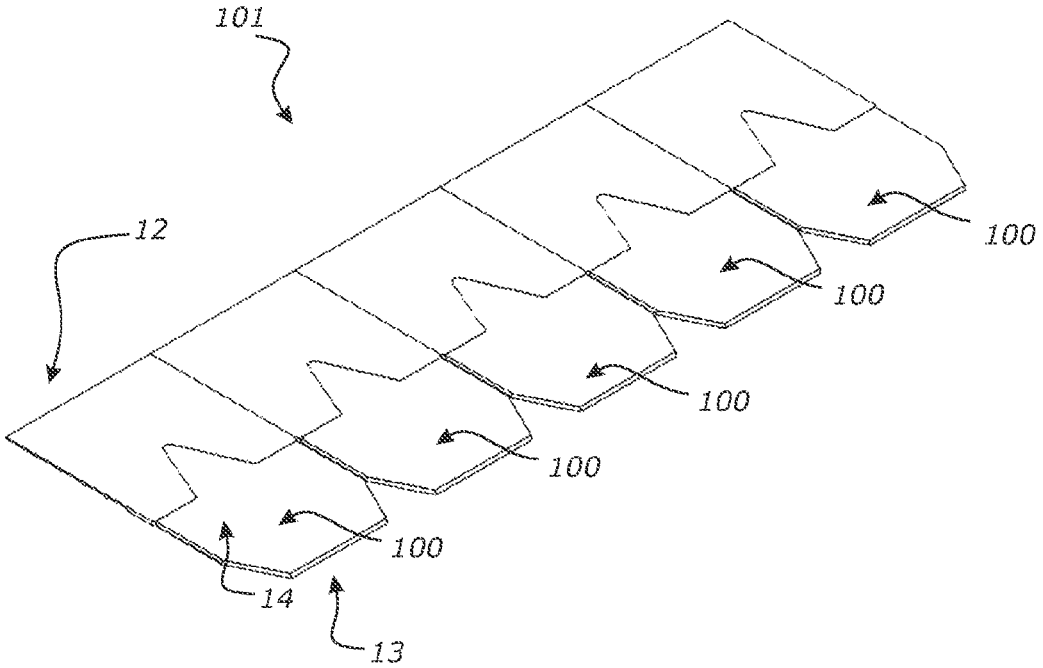

The member 100 may also comprises one or more cutting guides 30 (for example as shown in FIGS. 14A and 14B.)

The member 100 may also have an angled portion or face 53. The angled portion or face 53 may be similar to the member when the cutting guides 30 are used to remove the leading corners of the member 100 (as shown in FIGS. 14A and 14B). The angled portion or face 53 may be provided as a linear face or a non-linear (e.g. curved) face. The angled portion or face 53 may be provided from the leading edge 13 to a side or outer edge.

The member 100 may also comprise a stepped region 50. The stepped region 50 may be formed as a ramped portion. The stepped region 50 may comprise one or more, or a plurality of steps or ledges. The steps may function as an engagement feature as described above. The steps may function as a progressive series of surfaces upon which the underside of the underlapping region may engage the building surface. The steps may function as an arrangement in order to provide for a particular planar angle of the member 100 with respect to the building surface.

The exposed surface 14 of the member 100 may comprise a substantially tooth and/or U-shaped and/or V-shaped shaped portion 52 which extends towards the trailing edge 12 of the member 100.

The region 52 may comprise a stepped profile. The stepped profile of region 52 may comprise a substantially tooth and/or U-shaped and/or V-shaped shaped portion 52. The stepped profile may function as an engagement feature as described above.

The surface treatment (e.g. decoration or colouring or other material properties) is to be provided upon the exposed surface 14 or region and including the additional region 52. In one embodiment, the portion of the exposed surface 14 comprising the same surface treatment may extend as a substantially tooth shaped and/or U-shaped and/or V-shaped shaped portion 52.

Figure 12A:
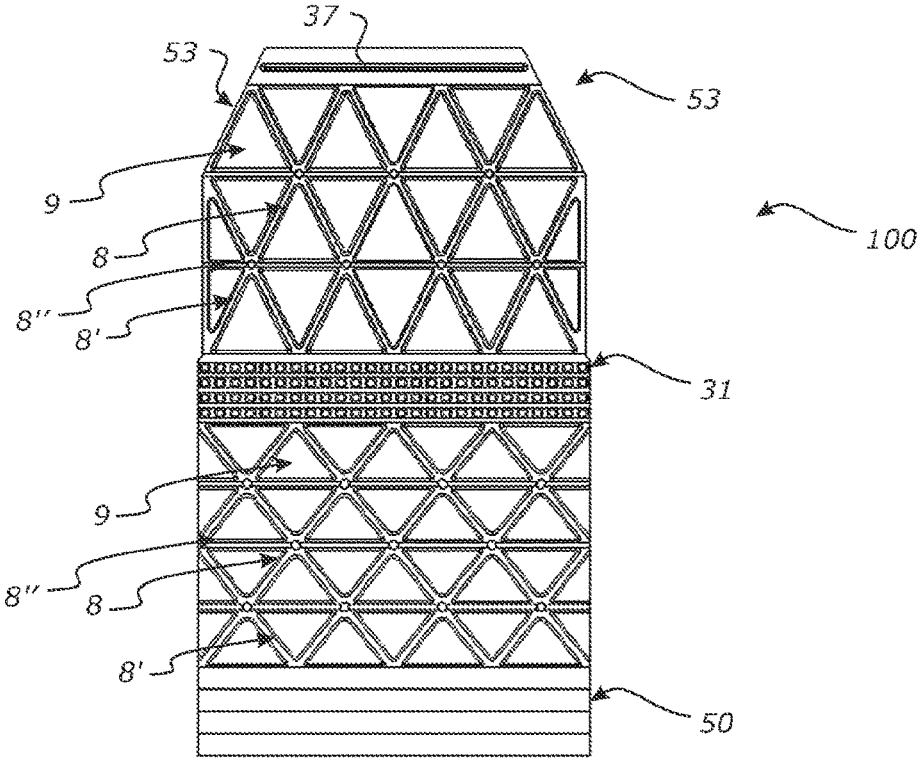
FIGS. 12A to 12C show various views of another embodiment of a member.
Figure 12B:
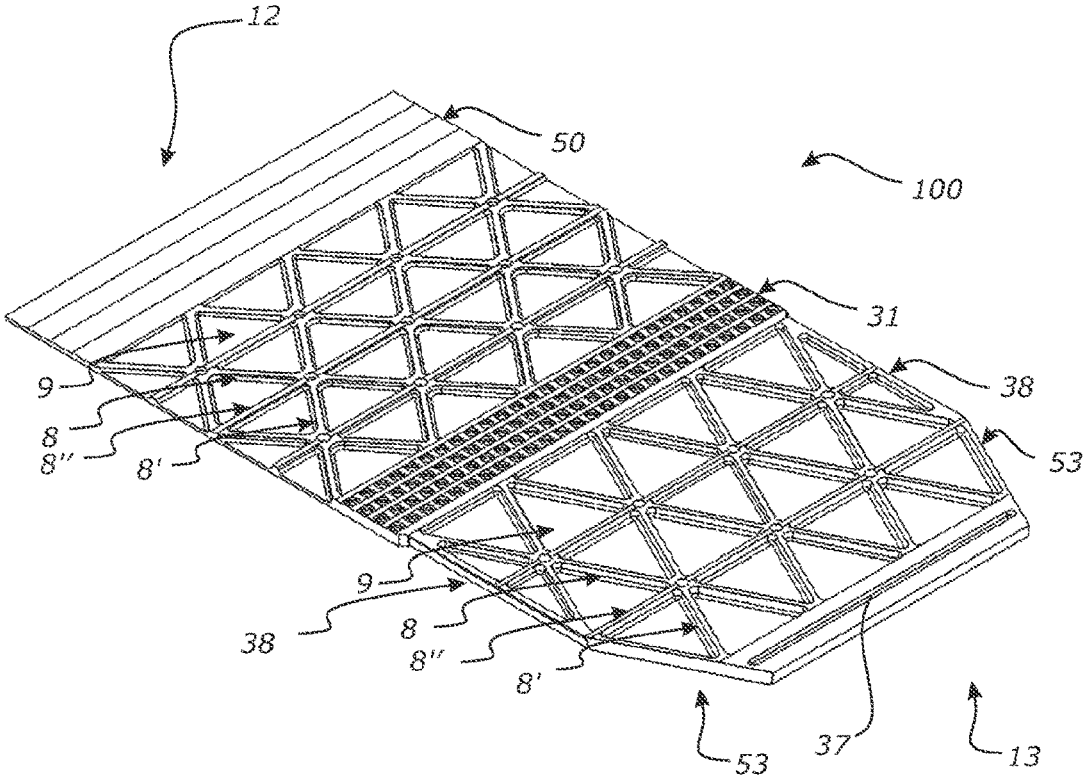
Figure 12C:
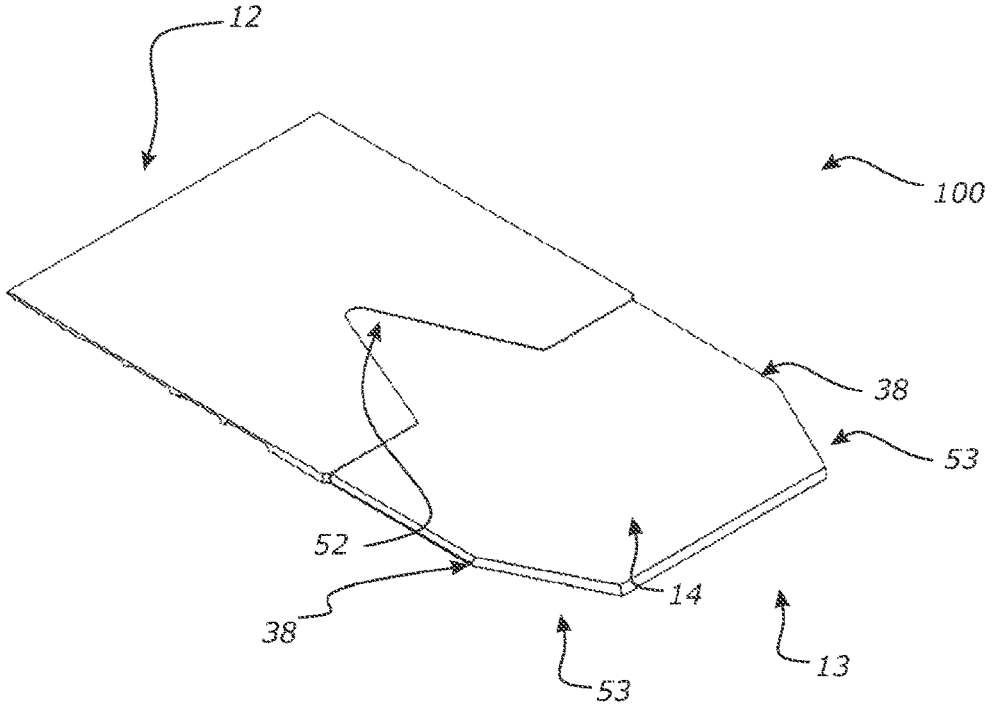
Figure 13A:
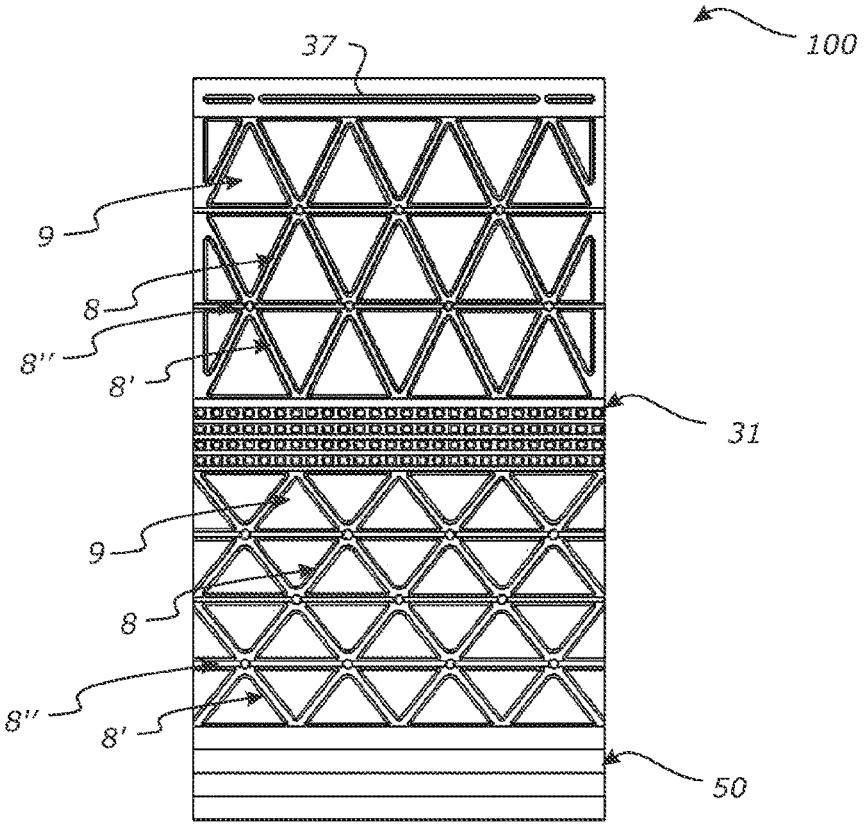
Figure 13B:
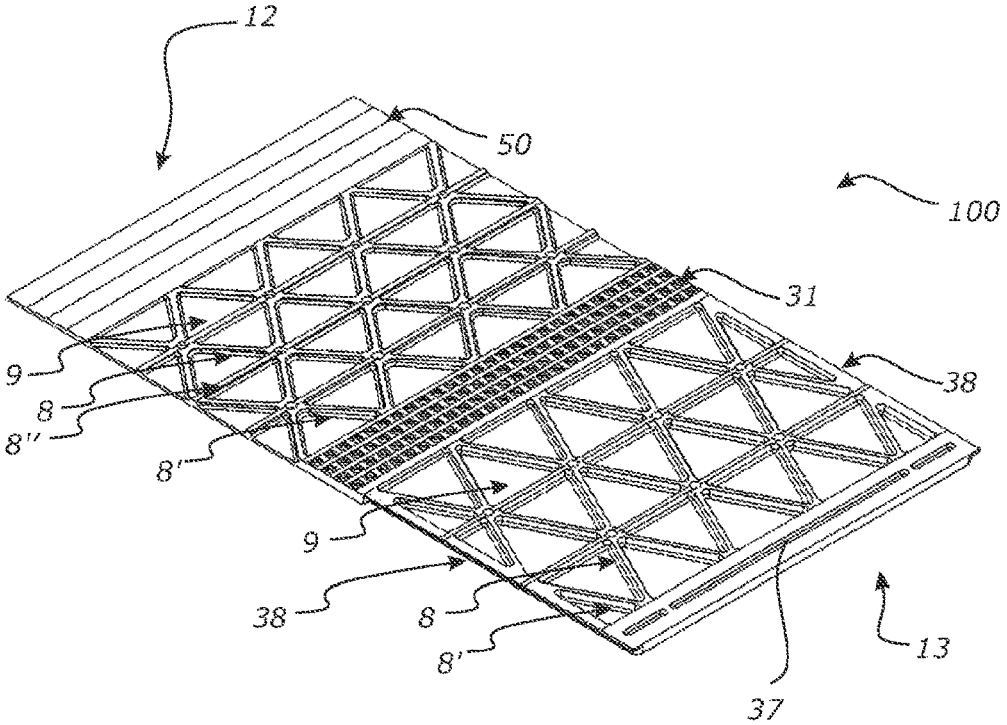
Figure 13C:
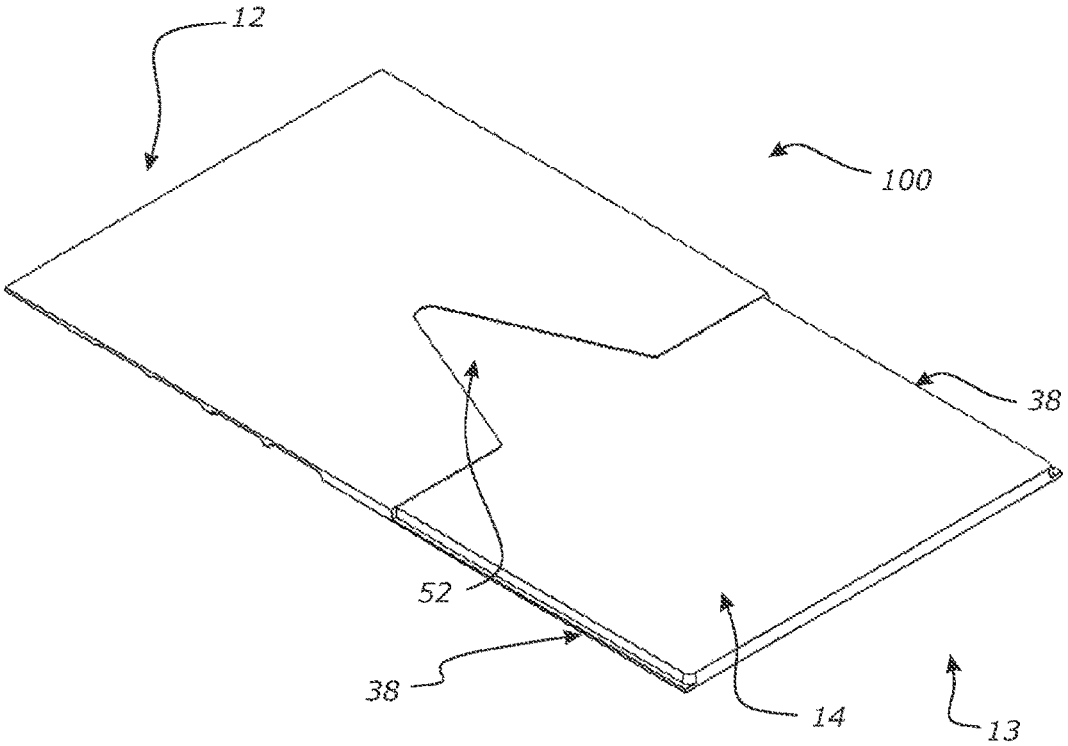

The region 52 may be so shaped or configured in size so as that when a further layer of adjacent members are placed on top of the member 13, and when that further layer has had one or more angled front portions 53 are provided for one a portion of the member is removed (for example as shown in FIG. 12C, or when cutting guides are used to modify the front surface of the tile), the exposed surface 14 with the necessary surface treatment is provided as a face or surface as region 52 in the gaps which are created between adjacent modules.

In some embodiments the region 52 may be shaped so as to substantially match the profile of the angled portion 53, such that when installed the exposed region as region 52 is visible in the gaps between adjacent modules being provided for in an overlaid overlapping arrangement upon a first layer of members or a member. The region 52 may be larger in area than the angled portion 53 and the gaps formed between adjacent modules, so that any exposed surface 14 of the member in gaps between adjacent modules is provided with a visual surface treatment commensurate with the exposed surface 14.

The aforementioned ridge or hip member 1 or member 100 may be provided in the form of a module which comprising a plurality of conjoined members 1, 100. The module may be formed as a plurality of regions, each region of which corresponds to a ridge or hip member 1 or member 100 as disclosed herein.

Where a module is provided (providing for a singularly formed component providing in one component a plurality of hip and ridge members), such a module would be provided with its own edge features, such edge features being those as described in relation to a ridge or hip member 1 or member 100, and each member portion of such a module being provided with its own cutting guide portions.

The ridge or hip module may be formed in a manner or configured to allow for one or more member portions to be separable from the module, thereby allowing for the provision of a resized module. In such an embodiment, a module may be manufactured as a standard unit item, which can be shipped and delivered to site. Customization of the ridge or hip module, or individual ridge or hip members may then be made on site according to the required dimensions or size parameters for the job.

The aforementioned roofing, cladding or siding member may be provided in the form of a module which comprising a plurality of conjoined members. The module may be formed as a plurality of regions, each region of which corresponds to a roofing, cladding or siding member as disclosed herein.

Where a module is provided (providing for a singularly formed component providing in one component a plurality of roofing, cladding or siding members), such a module would be provided with its own edge features, such edge features being those as described in relation to a roofing, cladding or siding member, and each member portion of such a module being provided with its own cutting guide portions.

The roofing, cladding or siding module may be formed in a manner or configured to allow for one or more member portions to be separable from the module, thereby allowing for the provision of a resized module. In such an embodiment, a module may be manufactured as a standard unit item, which can be shipped and delivered to site. Customization of the roofing, cladding or siding module, or individual roofing, cladding or siding members may then be made on site according to the required dimensions or size parameters for the job.

It will be appreciated that the above described ridge or hip member, or a module which is formed of a plurality of such members, may be installed as a system comprising a plurality of members installed in an overlapping/underlapping configuration as described above.

The foregoing description of the invention includes preferred forms thereof. Modifications may be made thereto without departing from the scope of the invention as defined by the accompanying claims.

The invention claimed is:

1. A ridge or hip member for a roof, the ridge or hip member comprising:

a substantially flexible zone, and a substantially rigid zone on each of a first side of the substantially flexible zone and a second side of the substantially flexible zone, the substantially flexible zone adapted to allow the ridge or hip member to be bent by an installer by hand to conform the ridge or hip member to a ridge or hip of the roof with the substantially flexible zone located along a ridge or hip line of the roof and with the substantially rigid zone located on each side of the ridge or hip line, wherein the substantially flexible zone is relatively more flexible than the substantially rigid zone on each of the first side and the second side, wherein the substantially flexible zone is configured to bend evenly or uniformly across a width of the substantially flexible zone to provide for a substantially constant radius of curvature across the substantially flexible zone when bent, and wherein the substantially flexible zone comprises an area of variable thickness such that the substantially flexible zone is stiffer along a first axis, in a direction of the ridge or hip line, than along a second axis, in a direction substantially transverse to the ridge or hip line, to allow the ridge or hip member to be bent along the second axis while resisting bending along the first axis, the area of variable thickness extending along a majority of a length of a lower surface of the ridge or hip member.

2. The ridge or hip member of claim 1, wherein the substantially flexible zone is located between the substantially rigid zone and a second substantially rigid zone, or the substantially flexible zone is flanked by a pair of the substantially rigid zone and a second substantially rigid zone.

3. The ridge or hip member of claim 1, wherein the substantially flexible zone extends from a leading edge of the ridge or hip member to a trailing edge.

4. The ridge or hip member of claim 1, the ridge or hip member comprising an overlapping region and an underlapping region, the underlapping region comprising at least one fluid channel in an upper surface of the underlapping region and extending across a width of the ridge or hip member.

5. The ridge or hip member of claim 4, wherein the upper surface of the underlapping region comprises a ramped region, the ramped region having a positive gradient, relative to a lower surface of the underlapping region, in a direction away from a trailing edge of the ridge or hip member towards a leading edge.

6. The ridge or hip member of claim 1, wherein the substantially flexible zone further comprises at least one of:

different geometry or material in the substantially flexible zone and the substantially rigid zone;

a concertina-type section in the substantially flexible zone;

a variation in material properties or material in the substantially flexible zone relative to the substantially rigid zone;

a reduced thickness in the substantially flexible zone relative to the substantially rigid zone;

a reinforced polymer in the substantially rigid zone or an unreinforced polymer in the substantially flexible zone; or a polymer of a first stiffness in the substantially flexible zone, and a polymer of a second stiffness in the substantially rigid zone, wherein the second stiffness is greater than the first stiffness.

7. The ridge or hip member of claim 1, wherein the substantially flexible zone has a minimum bend radius corresponding with a maximum bendable state of the substantially flexible zone.

8. The ridge or hip member of claim 1, wherein the substantially flexible zone has a longitudinal stiffness, or stiffness in a direction along the ridge or hip line, substantially equal to a longitudinal stiffness, or stiffness in a direction along the ridge or hip line, of the substantially rigid zone.

9. The ridge or hip member of claim 1, wherein the substantially flexible zone has a stiffness in a direction transverse to a longitudinal direction, or in the direction of a ridge or hip of the roof, less than the stiffness of the substantially rigid zone in the direction transverse to the longitudinal direction.

10. The ridge or hip member of claim 1, having a first elastic modulus or first stiffness in a width direction and a second elastic modulus or second stiffness in a length direction, the first elastic modulus or first stiffness less than the second elastic modulus or second stiffness.

11. The ridge or hip member of claim 1, wherein when bent or installed the substantially rigid zone stays substantially planar, and wherein when bent or installed, deflection of the ridge or hip member is of the substantially flexible zone.

12. The ridge or hip member of claim 1, wherein the substantially flexible zone comprises a plurality of spaced apart grooves in a lower surface of the ridge or hip member, the grooves arranged side-by-side across a width of the ridge or hip member and extending in a length direction of the ridge or hip member to be arranged along the ridge or hip line of the roof.

13. The ridge or hip member of claim 1, wherein the ridge or hip member has a first thickness in the substantially rigid zone and a second thickness in the substantially flexible zone, the first thickness greater than the second thickness.

14. The ridge or hip member of claim 1, wherein a first thickness of the ridge or hip member in the substantially flexible zone is less than a second thickness of the ridge or hip member in the substantially rigid zone.

15. The ridge or hip member of claim 1, wherein the substantially flexible zone is configured to bend to provide for an arc shaped profile across the substantially flexible zone.

16. The ridge or hip member of claim 1, wherein the substantially flexible zone comprises a flexible region to provide for flexibility, the flexible region located on an underside of the ridge or hip member.

17. The ridge or hip member of claim 16, wherein the flexible region does not extend through to an upper surface of the ridge or hip member so as to not be visible from the upper surface.

18. The ridge or hip member of claim 16, wherein the substantially flexible zone comprises at least a first layer and at least a second layer, the first layer at least in part defining the underside of the substantially flexible zone of the ridge or hip member, and the second layer defining at least in part an upper surface of the substantially flexible zone of the ridge or hip member to be exposed in use; and wherein the first layer comprises the flexible region, and wherein the second layer is a substantially flat or planar surface, or of a substantially uniform thickness.

19. The ridge or hip member of claim 1, wherein an exposed surface of the ridge or hip member is substantially flat, or the exposed surface comprises surface decoration or patterning or texturing to emulate natural or manmade roofing materials.

20. The ridge or hip member of claim 1, comprising a plurality of ribs on a lower surface.

21. The ridge or hip member of claim 1, wherein the ridge or hip member comprises at least one fastening zone, which fasteners may be provided to or pass therethrough, so as secure or provide for a securement of the ridge or hip member to a building surface or an adjacent ridge or hip member.

22. The ridge or hip member of claim 1, wherein the ridge or hip member comprises at least one edge feature, the at least one edge feature being located at, or near, or along one or more of: a side or outer edge, a leading edge, or a trailing edge.

23. The ridge or hip member of claim 22, wherein the at least one edge feature provides for a barrier to an underside of the ridge or hip member, and wherein the at least one edge feature provides for a visual barrier, such that when installed the underside of the ridge or hip member is not visible from the side or outer edge of the ridge or hip member.

24. The ridge or hip member of claim 1, wherein the ridge or hip member comprises at least one cutting guide.

25. The ridge or hip member of claim 24, wherein the at least one cutting guide is located on an underside of an exposed region of the ridge or hip member.

26. The ridge or hip member of claim 24, wherein the at least one cutting guide comprises at least one of:

a thinned region;

a slot; or a region of reduced member material thickness.

27. The ridge or hip member of claim 24, wherein the ridge or hip member comprises a raised wall or an edge feature located along at least one side or around the at least one cutting guide.

28. The ridge or hip member of claim 24, wherein the at least one cutting guide is configured to allow removal of at least one leading corner, or other portions, of the ridge or hip module.

29. The ridge or hip member of claim 24, wherein the at least one cutting guide comprises a first cutting guide or a first set of cutting guides and a second cutting guide or a second set of cutting guides.

30. The ridge or hip member of claim 29, wherein the first set of cutting guides extend in a direction along an axis or in a direction, or provides for a cutting guide pathway, that extends from a leading edge of the ridge or hip member towards or to a first outer or side edge of the ridge or hip member, and wherein the second set of cutting guides extend in a direction along an axis or in a direction, or provides for a cutting guide pathway, that extends from the leading edge of the ridge or hip member towards or to a second outer or side edge of the ridge or hip member.

31. The ridge or hip member of claim 24, wherein each of the at least one cutting guide, or corresponding pairs of cutting guides in the first and second sets of cutting guides, corresponds with a particular roof pitch angle.

32. The ridge or hip member of claim 24, wherein the at least one cutting guide is of a linear cutting guide pathway or is of a non-linear cutting guide pathway.

33. A ridge or hip member for a roof, the ridge or hip member comprising:

a substantially flexible zone, and a substantially rigid zone on each of a first side of the substantially flexible zone and a second side of the substantially flexible zone, the substantially flexible zone adapted to allow the ridge or hip member to be bent by an installer by hand to conform the ridge or hip member to a ridge or hip of the roof with the substantially flexible zone located along a ridge or hip line of the roof and with the substantially rigid zone located on each side of the ridge or hip line, wherein the substantially flexible zone is relatively more flexible than the substantially rigid zone on each of the first side and the second side, and wherein the substantially flexible zone is configured to bend evenly or uniformly across a width of the substantially flexible zone, wherein the ridge or hip member comprises at least one cutting guide, the at least one cutting guide extends from a leading edge of the ridge or hip member across part of the substantially flexible zone, and at least part of the substantially rigid zone to an outer edge of the ridge or hip member.

34. The ridge or hip member of claim 33, wherein the at least one cutting guide is located on an underside of an exposed region of the ridge or hip member.

35. The ridge or hip member of claim 33, wherein the at least one cutting guide comprises at least one of:

a thinned region;

a slot; or a region of reduced member material thickness.

36. The ridge or hip member of claim 33, wherein the ridge or hip member comprises a raised wall or an edge feature located along at least one side or around the at least one cutting guide.

37. The ridge or hip member of claim 33, wherein the ridge or hip member comprises at least one fastening zone, which fasteners may be provided to or pass therethrough, so as secure or provide for a securement of the ridge or hip member to a building surface or an adjacent ridge or hip member.

38. A roofing, cladding, or siding member comprising:

an upper surface comprising an exposed surface or region, an underlapping region configured to be covered in use by an overlapping region of an adjacent roofing, cladding, or siding member, at least one cutting guide configured to allow for the resizing of the roofing, cladding, or siding member or removal of a portion of the roofing, cladding, or siding member, a substantially flexible zone, and a substantially rigid zone on each of a first side of the substantially flexible zone and a second side of the substantially flexible zone, the substantially flexible zone adapted to allow the roofing, cladding, or siding member to be bent by an installer by hand to conform the roofing, cladding, or siding member to a ridge or hip of a roof with the substantially flexible zone located along a ridge or hip line of the roof and with the substantially rigid zone located on each side of the ridge or hip line, wherein the substantially flexible zone is relatively more flexible than the substantially rigid zone on each of the first side and the second side, wherein the substantially flexible zone is configured to bend evenly or uniformly across a width of the substantially flexible zone to provide for a substantially constant radius of curvature across the substantially flexible zone when bent, and wherein the substantially flexible zone comprises an area of variable thickness such that the substantially flexible zone is stiffer along a first axis, in a direction of the ridge or hip line, than along a second axis, in a direction substantially transverse to the ridge or hip line, to allow the ridge or hip member to be bent along the second axis while resisting bending along the first axis, the area of variable thickness extending along a length of a lower surface of the ridge or hip member.

39. The roofing, cladding, or siding member of claim 38, wherein the substantially flexible zone further comprises at least one of:

different geometry or material in the substantially flexible zone and the substantially rigid zone;

a concertina-type section in the substantially flexible zone;

a variation in material properties or material in the substantially flexible zone relative to the substantially rigid zone;

a reduced thickness in the substantially flexible zone relative to the substantially rigid zone;

a reinforced polymer in the substantially rigid zone or an unreinforced polymer in the substantially flexible zone; or a polymer of a first stiffness in the substantially flexible zone, and a polymer of a second stiffness in the substantially rigid zone, wherein the second stiffness is greater than the first stiffness.

40. A roofing, cladding, or siding member comprising:

an upper surface comprising an exposed surface or region, an underlapping region configured to be covered in use by an overlapping region of an adjacent roofing, cladding, or siding member, and at least one cutting guide configured to allow for the resizing of the roofing, cladding, or siding member or removal of a portion of the roofing, cladding, or siding member, a substantially flexible zone, and a substantially rigid zone on each of a first side of the substantially flexible zone and a second side of the substantially flexible zone, the substantially flexible zone adapted to allow the roofing, cladding, or siding member to be bent by an installer by hand to conform the roofing, cladding, or siding member to a ridge or hip of a roof with the substantially flexible zone located along a ridge or hip line of the roof and with the substantially rigid zone located on each side of the ridge or hip line, wherein the substantially flexible zone is relatively more flexible than the substantially rigid zone on each of the first side and the second side, wherein the substantially flexible zone is configured to bend evenly or uniformly across a width of the substantially flexible zone, and wherein the at least one cutting guide extends from a leading edge of the roofing, cladding or siding member across part of the substantially flexible zone and at least part of the substantially rigid zone to an outer edge of the roofing, cladding or siding member.

41. The ridge or hip member of claim 40, wherein the at least one cutting guide is located on an underside of an exposed region of the ridge or hip member.

42. The ridge or hip member of claim 40, wherein the at least one cutting guide comprises at least one of:

a thinned region;

a slot; or a region of reduced member material thickness.

43. The ridge or hip member of claim 40, wherein the ridge or hip member comprises a raised wall or an edge feature located along at least one side or around the at least one cutting guide.

44. The ridge or hip member of claim 40, wherein the ridge or hip member comprises at least one fastening zone, which fasteners may be provided to or pass therethrough, so as secure or provide for a securement of the ridge or hip member to a building surface or an adjacent ridge or hip member.

* * * * *